US007140906B2

(12) United States Patent
Takahashi

(10) Patent No.: US 7,140,906 B2
(45) Date of Patent: Nov. 28, 2006

(54) MODULAR PLUG

(75) Inventor: Seigo Takahashi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/848,428

(22) Filed: May 18, 2004

(65) Prior Publication Data

US 2004/0235360 A1 Nov. 25, 2004

(30) Foreign Application Priority Data

May 19, 2003 (JP) ..... 2003-141030

(51) Int. Cl.
*H01R 11/20* (2006.01)
*H01R 4/26* (2006.01)
*H01R 4/24* (2006.01)

(52) U.S. Cl. ..... 439/418

(58) Field of Classification Search ..... 439/676, 439/418, 941, 620, 344, 460, 607, 701, 449, 439/455

See application file for complete search history.

(56) References Cited

U.S. PATENT DOCUMENTS 5,899,770 A * 5/1999 Ezawa ..... 439/418
6,193,542 B1 * 2/2001 Marowsky et al. ..... 439/418
6,354,865 B1 * 3/2002 Bogese ..... 439/418

* cited by examiner

*Primary Examiner*—Javaid H. Nasri
(74) *Attorney, Agent, or Firm*—Katten Muchin Rosenman LLP

(57) ABSTRACT

A modular plug has a modular housing, a first array of terminals retracted from a second array of terminals disposed at the front end of the modular housing. The unraveled wires are received in respective slots arranged in two rows in the housing. The slots have a shield function for preventing, the cross-talk between the unraveled wires.

11 Claims, 24 Drawing Sheets

(PRIOR ART)

(PRIOR ART)

(PRIOR ART)

MODULAR PLUG

BACKGROUND OF THE INVENTION (a) Field of the Invention

The present invention relates to a modular plug and, more particularly, to a modular plug capable of improving cross-talk characteristics of the higher-frequency signal components in the signal transmitted through the modular plug.

(b) Description of the Related Art

Modular plugs are generally attached onto both ends of modular cables connecting together a variety of information equipment such as telephone set, personal computer, modem and facsimile. The modular cable connecting together the information equipment such as a personal computer for communications includes a plurality of twisted-wire pairs, wherein a specified modular plug is connected to each end of the modular cable for the convenience of electrical connection and for adapting the request from the standardized equipment.

FIGS. 23 and 24 show a conventional modular plug connected to an end of a modular cable 11 in perspective views. FIG. 23 shows the modular plug 12 from the topside thereof mounting thereon pressure contact terminals 13, whereas FIG. 24 shows the modular plug 12 from the bottom side thereof mounting thereon a clip 14.

FIG. 25 shows the conventional modular plug 12 during connection to a modular cable 11 including a plurality of twisted-wire pairs 16. The front end portions 17 of the twisted wires of a twisted-wire pair 16 are unraveled, or released from one another, and the unraveled wires 17 are inserted into the housing 19 of the modular plug 12 in the direction of an arrow 18. Each tip of the unraveled wire 17 is fixed by a pressure contact terminal (terminal), which is not specifically shown in the drawing and pressed by a corresponding electrode of the modular jack.

Mere insertion of the wires 11 into the modular housing 19 and application of the pressure contact to the wires provide the structure of the connected modular plug shown in FIGS. 23 and 24. The modular plug 12 is used in combination with a modular jack as a connector by inserting the modular plug 12 into the opening of a modular jack. This combination of connector is widely used in the communication industry due to a low cost for the connection.

In a data network communication equipment, there is an ever request for a higher bit-rate communication and a problem of an increased terminal cross-talk, especially in a broadband communication. The term "terminal cross-talk" as used in this text means a cross-talk occurring in a connector nearest to the communication equipment, wherein the output signal of a transmitter in the equipment is mixed into the input signal of a receiver in the equipment. The terminal cross-talk results from a capacitive coupling between adjacent wires or between adjacent electrodes in the modular connector, degrading the signal quality in the communication.

For example, the twisted wires of a wire pair 16 in the modular cable 11 shown in FIG. 25 are unraveled from the twisting at the tip portion 17 of the wires to extend parallel to one another, thereby generating terminal cross-talk at the parallel running portions of the wires.

TIA/EIA-568 (TIA/EIA; The US Telecommunications Industries Association and Electronics Industries Association) issued by ANSI (American National Standards Institute) and ISO/IEC-11801 (ISO/IEC: International Organization for Standardization) prescribe standards of wire connection, which is vulnerable to an external electric disturbance and susceptible to the cross-talk.

FIG. 26 schematically shows an example of conventional connections of wires to a modular plug, wherein first to fourth wire pairs $\mathbf{16}_1$ to $\mathbf{16}_4$ are connected to first to eighth terminals $\mathbf{21}_1$ to $\mathbf{21}_8$ of a terminal board 13 of the modular plug. The wires of first wire pair $\mathbf{16}_1$ and fourth wire pair $\mathbf{16}_4$ are connected to the respective terminals in the order of arrangement of the wire pairs $\mathbf{16}_1$ and $\mathbf{16}_4$ and arrangement of the terminals $\mathbf{21}_1$, $\mathbf{21}_2$, $\mathbf{21}_7$ and $\mathbf{21}_8$. In this example, by setting the distance between the first wire pair $\mathbf{16}_1$ and the second wire pair $\mathbf{16}_2$ and the distance between the third wire pair $\mathbf{16}_3$ and fourth wire pair $\mathbf{16}_4$ larger than the distance between second wire pair $\mathbf{16}_2$ and the third wire pair $\mathbf{16}_3$, the cross-talk between the unraveled wires running parallel to one another after unraveling from the twisted state can be alleviated.

However, the connections of the wires to the terminals of the modular plug involve an intersection between one of the unraveled wires from the second wire pair $\mathbf{16}_2$ and unraveled wires from the third wire pair $\mathbf{16}_3$ due to the arrangement of the terminals $\mathbf{21}_3$, $\mathbf{21}_4$, $\mathbf{21}_5$ and $\mathbf{21}_6$ of the terminal board 13 The intersection between the unraveled wires incurs the problems of external disturbance and cross-talk therebetween. JP Patent Publication 2002-510854 of a PCT application, for example, describes a technique for reducing the influence by cross-talk in such a case (FIGS. 32 and 33 in the publication).

FIG. 27 shows the structure described in the patent publication, wherein a support block 31 depicted in a sectional view is disposed in the vicinity of the terminal board in the modular plug, the support block 31 having slots for passing therethrough and supporting the unraveled wires $\mathbf{32}_1$ to $\mathbf{32}_8$. These slots are arranged such that the wires $\mathbf{32}_3$ and $\mathbf{32}_6$ are disposed at a vertical distance D1 apart from the other wires, as viewed from the center-to-center distance. The larger distance between the unraveled wires 32 reduces the capacitive coupling between the wires 32 and thus the cross-talk therebetween.

In the structure described in the patent publication, however, there also remains portions of the unraveled wires of the wire pairs running parallel to one another outside the support block 3. The parallel running of the unraveled wires inevitably incurs the problem of the terminal cross-talk depending on the bit rate of the data communication.

SUMMARY OF THE INVENTION

In view of the above, it is an object of the present invention to provide a modular plug capable of reducing the terminal cross-talk, while maintaining the interchangeability between the modular plug and one of the conventional modular plugs that are wide-spread in the communication industries and thus obviating the need for replacing the modular jack to be coupled with the modular plug of the present invention.

The present invention provides a modular plug including: a modular housing having a front surface to be coupled with a modular jack and a rear end to be coupled with a modular cable; a first group of terminals arranged in the modular housing in a first array parallel to the front surface; and a second group of terminals arranged in the modular housing in a second array parallel to the first array, the first array being disposed at a specified distance retracted from the second array in a direction normal to the front surface, the first and second groups of terminals being located so that said first and second groups of terminals are contacted with respective electrodes of the modular jack upon coupling of the modular housing to the modular jack.

In accordance with the present invention, the retracted group of terminals reduces the length of the unraveled wires of the modular cable to thereby reduce the capacitive coupling and cross-talk between the unraveled wires.

The above and other objects, features and advantages of the present invention will be more apparent from the following description, referring to the accompanying drawings.

PREFERRED EMBODIMENT OF THE INVENTION

Figure 1:
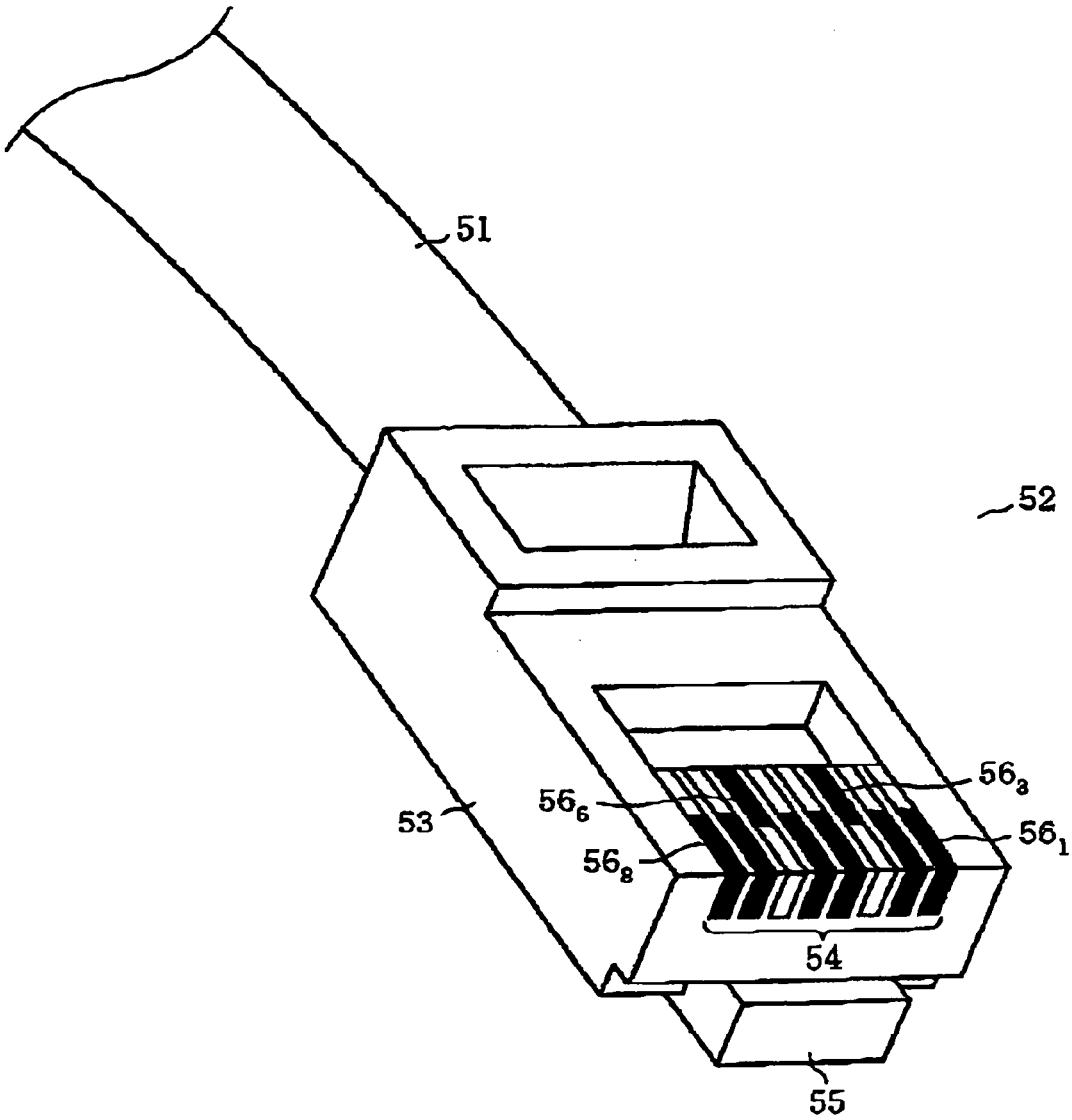
FIG. 1 is a perspective view of a modular plug, according to an embodiment of the present invention, attached to an end of a modular cable.

Now, the present invention is more specifically described with reference to accompanying drawings, wherein suffixes of the reference numerals represent the sequential orders of similar constituent elements and may sometimes correspond to suffixes specifying the other constituent elements or accessories corresponding to the constituent elements.

Referring to FIG. 1, a modular plug, generally designated by numeral 52, according to an embodiment of the present invention is shown as attached to an end of a modular cable 51. The modular plug 52 includes a modular housing 53, a terminal board 54 including a plurality of terminals 56 exposed from the front end (front surface) and top side of the modular housing 53, and a clip (engagement member) 55 disposed on the bottom surface of the modular housing 53 to engage with the corresponding member of the modular jack not shown.

Figure 23:
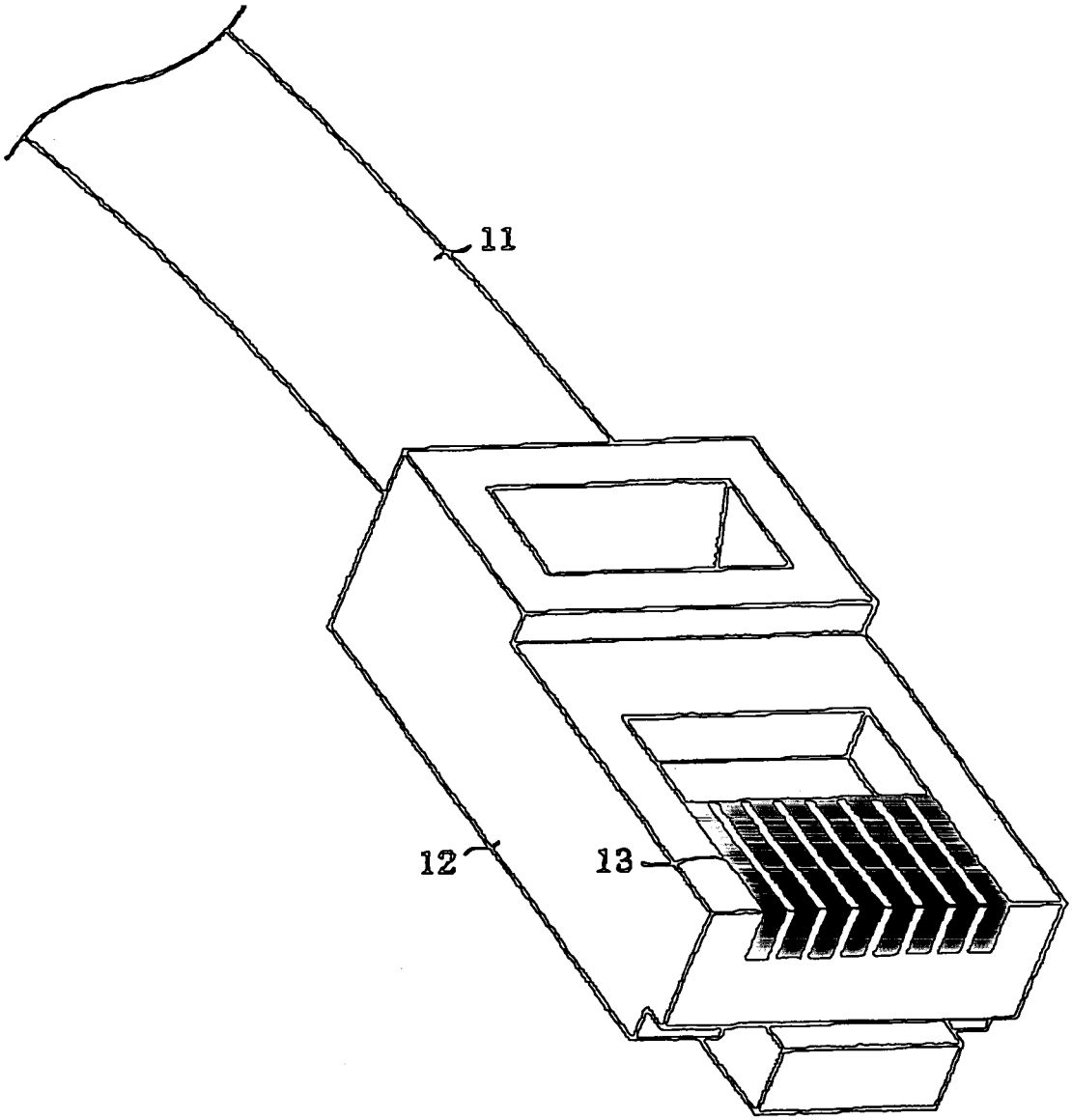
FIG. 23 is a perspective view of a conventional modular plug.
Figure 24:
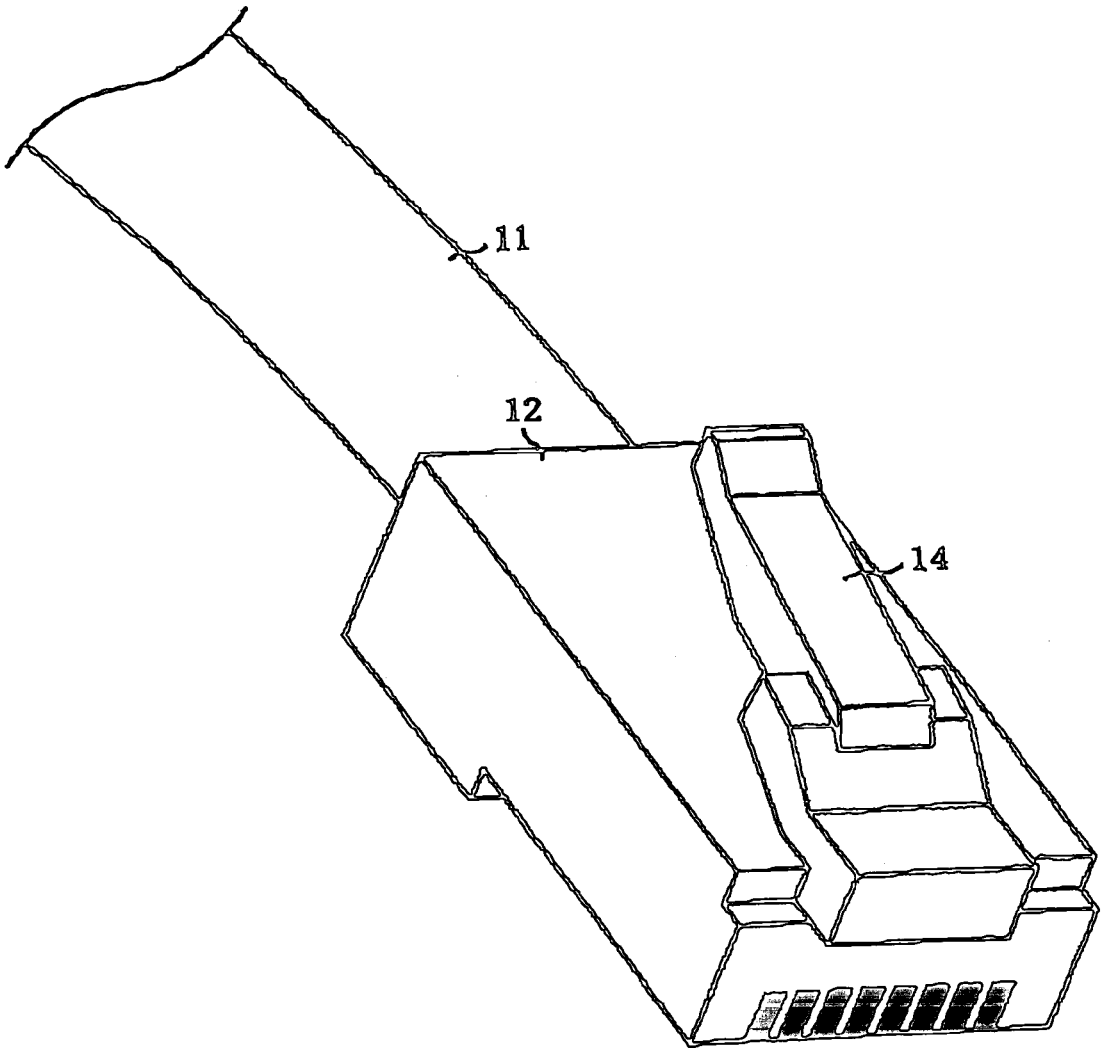
FIG. 24 is another perspective view of the conventional modular plug of FIG. 23, as viewed topside down from FIG. 23.
Figure 25:
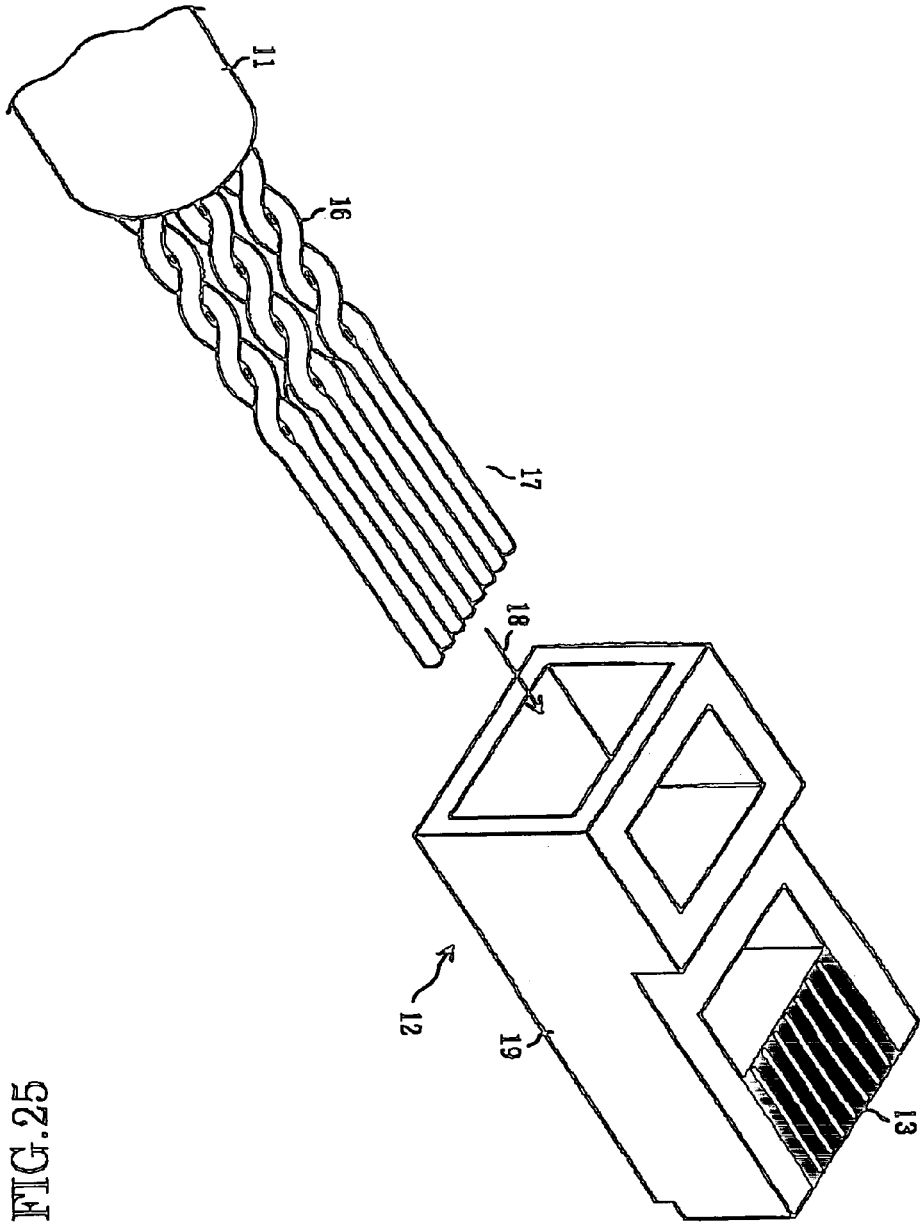
FIG.25 (PRIOR ART)
FIG. 25 is a perspective view showing the conventional modular plug of FIG. 23 attached to wires.
Figure 26:
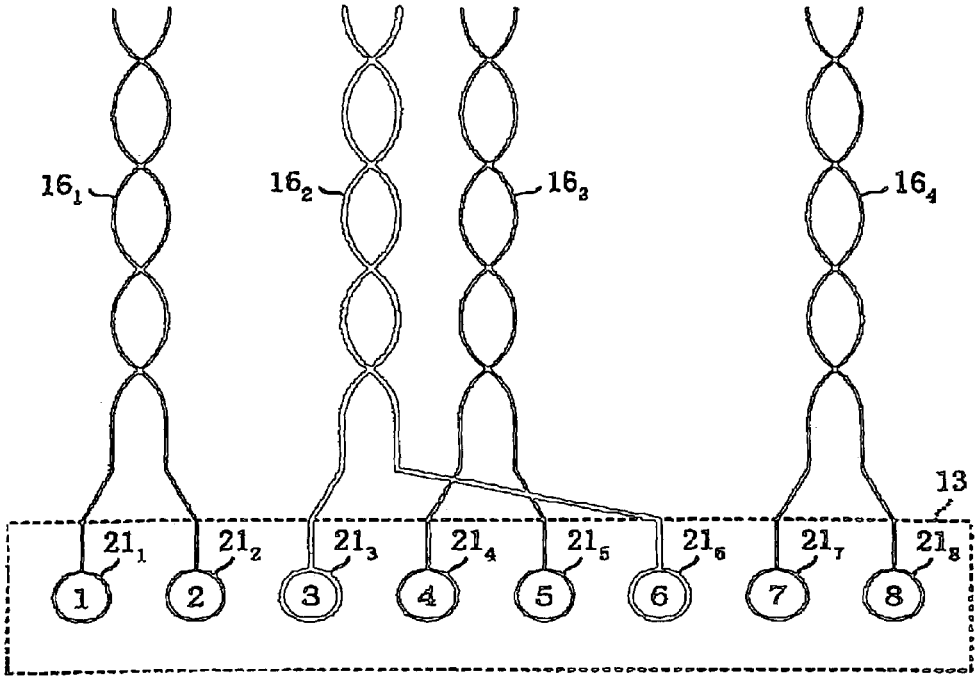
FIG. 26 is a schematic view showing the conventional connections of wires to terminals of a terminal board.
Figure 27:
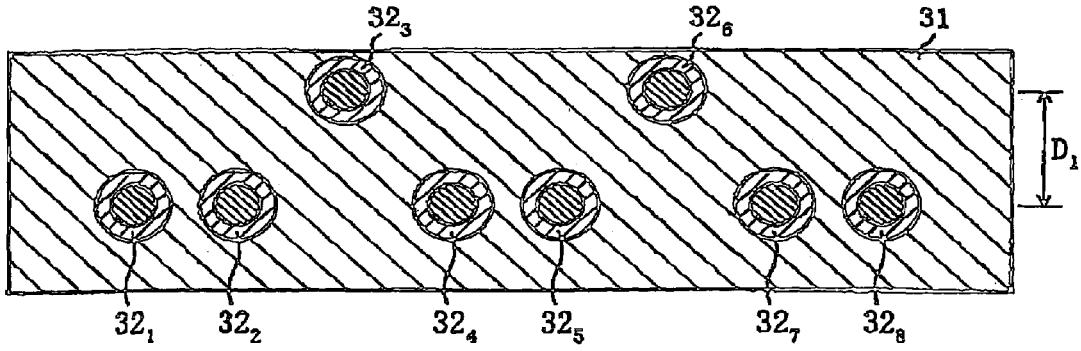
(PRIOR ART) FIG.27
FIG. 27 is a sectional view of a support block for arranging and supporting wires in a modular plug described in a patent publication.

The structure of the modular plug 52 shown in FIG. 1 is similar to the conventional modular plug 12 shown in FIG. 23, except that some of the pressure contact terminals (may be referred to as merely "terminals" hereinafter) $\mathbf{56}_1$ to $\mathbf{56}_8$ marked with black in the drawing are somewhat retraced from the front end of the modular housing 53 in the direction of insertion of the modular plug 52 into the modular jack.

More specifically, the third and sixth terminals $\mathbf{56}_3$ and $\mathbf{56}_6$ in this example form an array retracted from the front end of the modular housing 52 and from the array of the other terminals $\mathbf{56}_1$, $\mathbf{56}_2$, $\mathbf{56}_4$, $\mathbf{56}_5$, $\mathbf{56}_7$ and $\mathbf{56}_8$.

Figure 2:
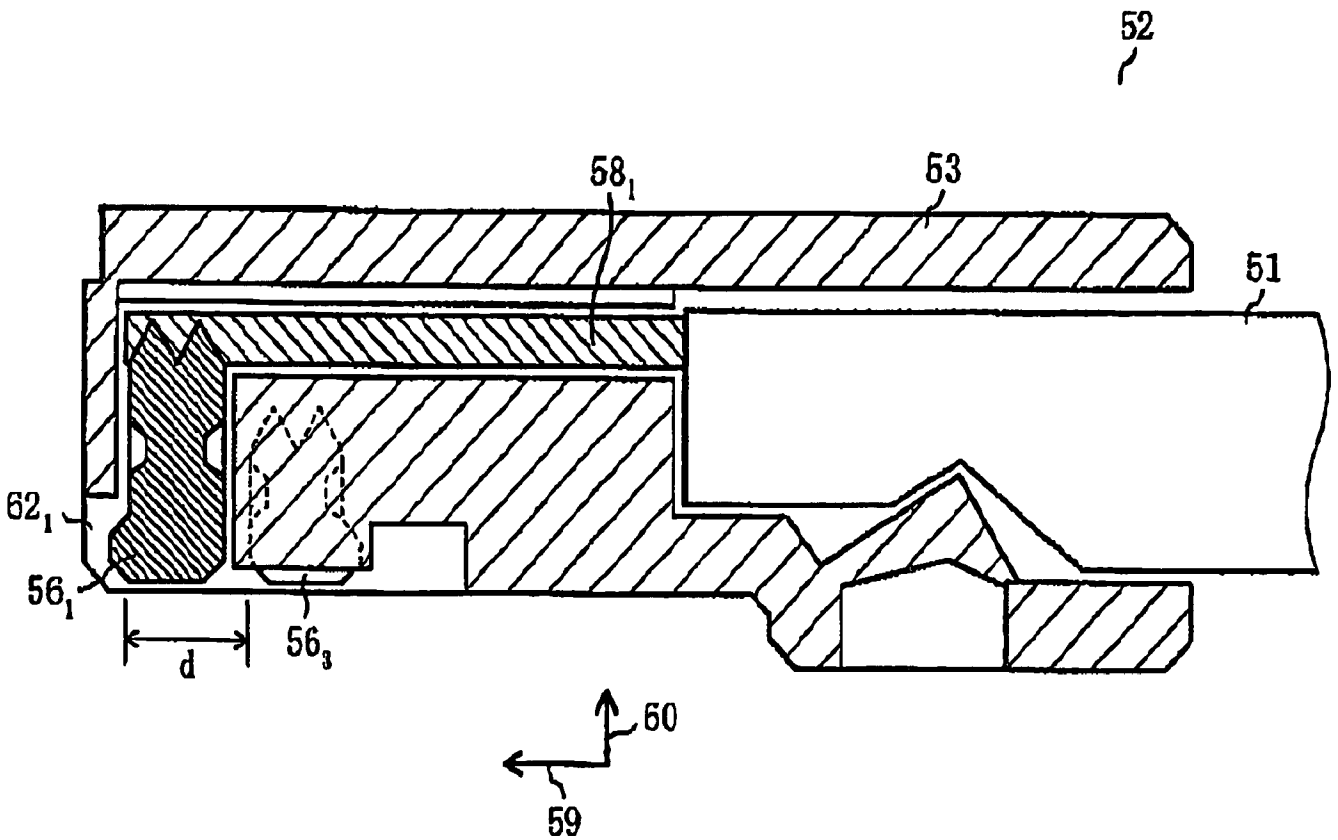
FIG. 2 is a longitudinal sectional view of the modular plug of FIG. 1, taken in a plane passing through the first pressure contact terminal of the modular plug.
Figure 3:
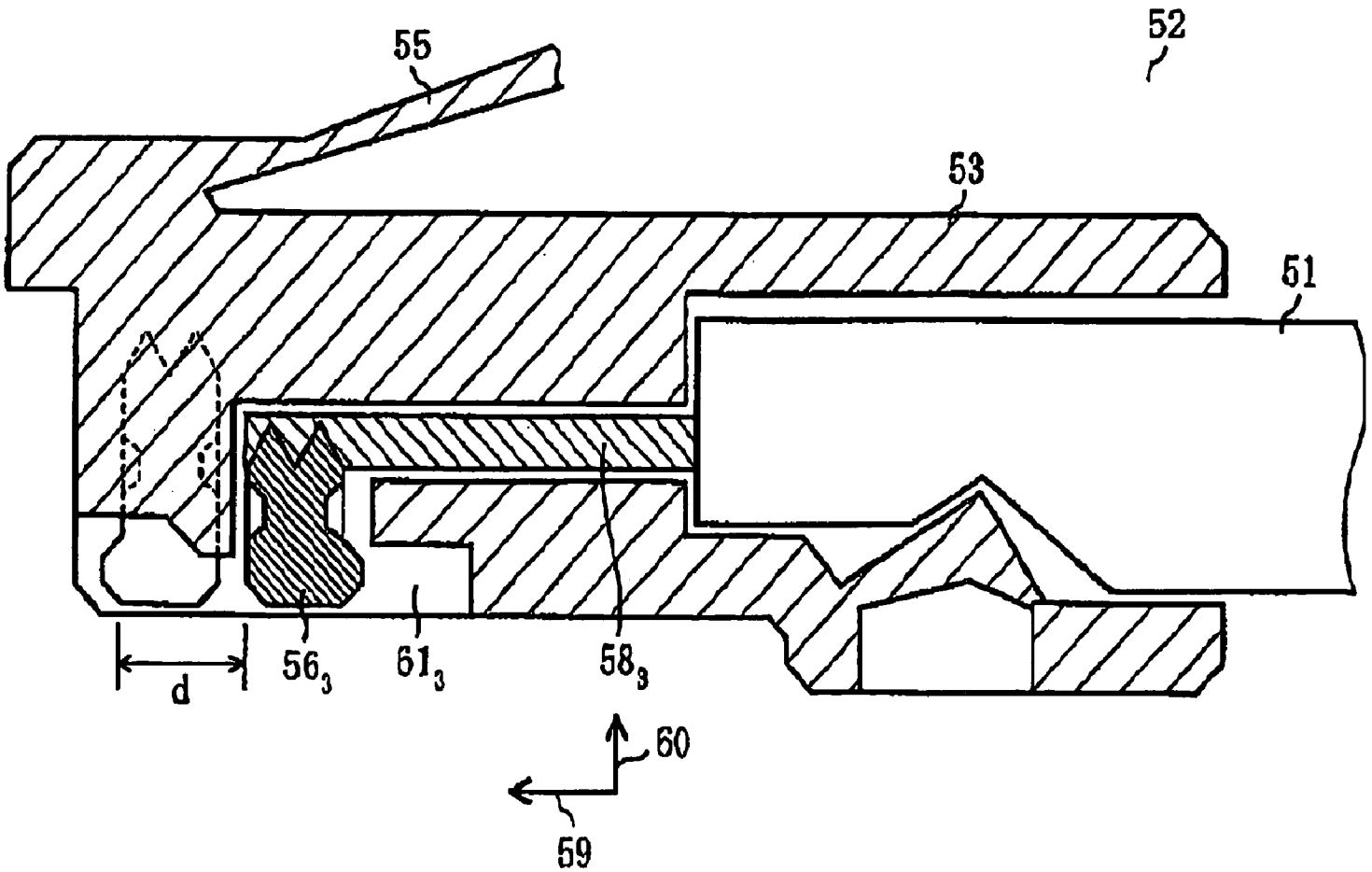
FIG. 3 is a longitudinal sectional view of the modular plug of FIG. 1, taken in a plane passing through the third pressure contact terminal of the modular plug.

Referring to FIGS. 2 and 3, there are shown longitudinal sectional views taken along the planes passing through the first terminal $\mathbf{56}_1$ and the third terminal $\mathbf{56}_3$, respectively, both of which represent the non-retracted terminals and retracted terminals.

As understood from FIG. 2, the wire connected to the terminal $\mathbf{56}_1$ which is not retracted from the front end of the modular housing 53 has a relatively long unraveled end portion $\mathbf{58}_1$ running parallel to the unraveled end portion of the other wires. The tip of the unraveled portion $\mathbf{58}_1$ of the wire is pressed by and thus in contact with the corresponding pressure contact terminal $\mathbf{56}_1$. On the other hand, as understood from FIG. 3, the wire connected to the terminal $\mathbf{56}_3$ which is retracted from the front end of the modular housing 53 has a shorter unraveled end portion $\mathbf{58}_3$, compared to the unraveled end portion $\mathbf{58}_1$ of the first wire, the tip of the unraveled portion $58_3$ being also pressed by and thus in contact with the corresponding pressure contact terminal $56_3$.

The retracted terminals $56_3$ and $56_6$ are shorter than the other terminals $56_1$, $56_2$, $56_4$, $56_5$, $56_7$ and $56_8$ corresponding to the distance between the array of the unraveled wires $58_3$ and $58_8$ connected to the retracted terminals and the array of the unraveled wires $58_1$, $58_2$, $58_4$, $58_5$, $58_7$ and $58_8$ connected to the other terminals in the direction normal to the insertion direction of the wires.

Comparing the structure of FIG. 3 against the structure of FIG. 2, the location of the terminal $56_3$ is deviated from the location of the terminal $56_1$ in the direction (inserting direction) shown by arrow 59, in which the wires are inserted for connection to the terminals. Although these terminals may be located so that portions of these terminals are juxtaposed in the inserting direction 59, the length of the portions thus juxtaposed should be as small as possible for reducing the cross-talk.

Corresponding to the group of terminals $56_3$ and $56_6$ deviated from the other group of terminals $56_1$, $56_2$, $56_4$, $56_5$, $56_7$ and $56_8$ in the inserting direction 59, the group of unraveled portions (wires) $58_3$ and $58_6$ is also deviated from the other group of unraveled portions (wires) $58_1$, $58_2$, $58_4$, $58_5$, $58_7$ and $58_8$ in the direction 60 normal to the inserting direction 59, as understood from FIGS. 2 and 3. This structure reduces the capacitive coupling and thus cross-talk between the wire pairs.

Figure 4:
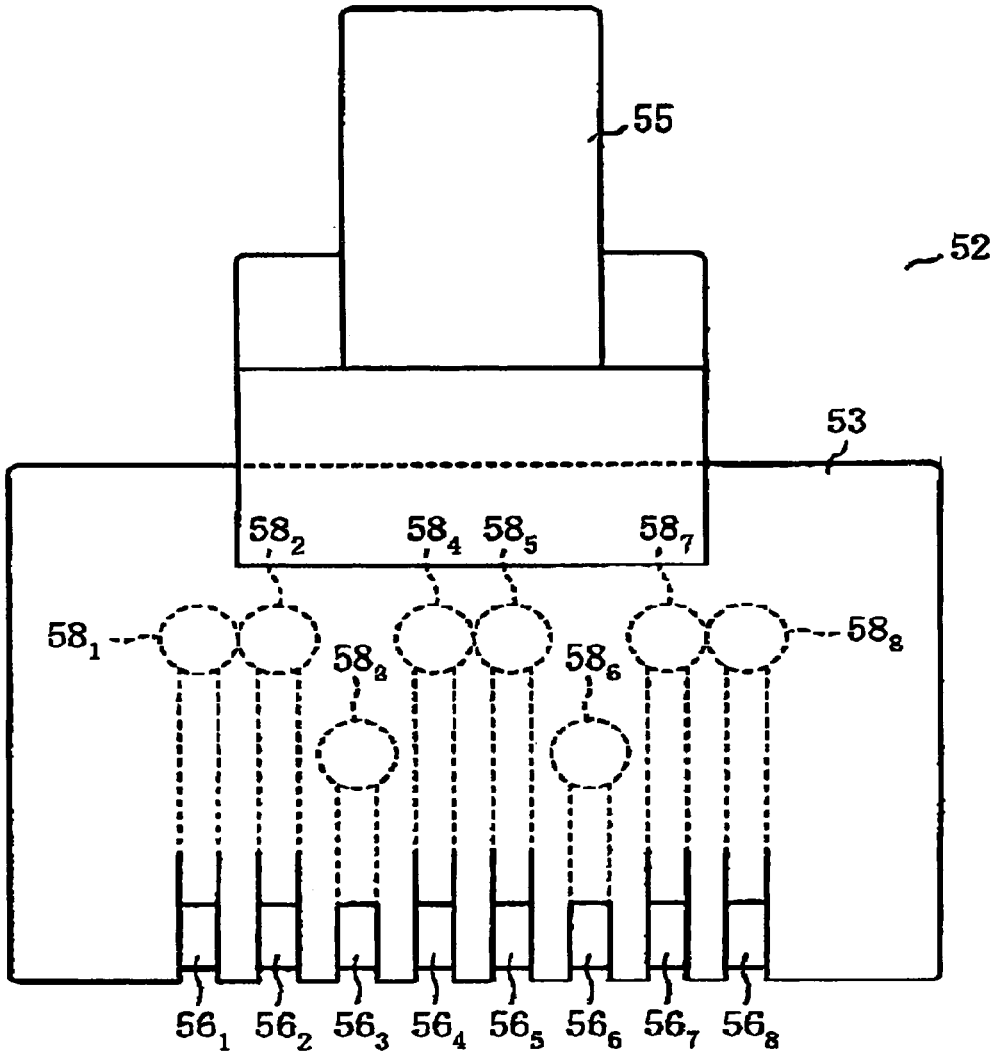
FIG. 4 is a front view of the modular plug of FIG. 1, as viewed from the modular jack to be coupled to the modular plug.

Referring to FIG. 4 showing the front view of the modular plug of FIG. 1, the distance between the unraveled wires $58_3$ and $58_6$ and the corresponding terminals $56_3$ and $56_6$ is smaller than the distance between the unraveled wires $58_1$, $58_2$, $58_4$, $58_5$, $58_7$ and $58_8$ and the corresponding terminals $56_1$, $56_2$, $56_4$, $56_5$, $56_7$ and $56_8$.

The terminals $56_3$ and $56_8$ are retracted from the front end of the modular housing 53, as described before. It should be considered that the retracted terminals $56_3$ and $56_8$ do not adversely affect the electric contact between the same and corresponding electrodes of the modular jack to thereby maintain the interchangeability of the conventional modular plug with the modular plug of the present embodiment. This is achieved by the structure of the modular plug as described hereinafter.

Figure 5:
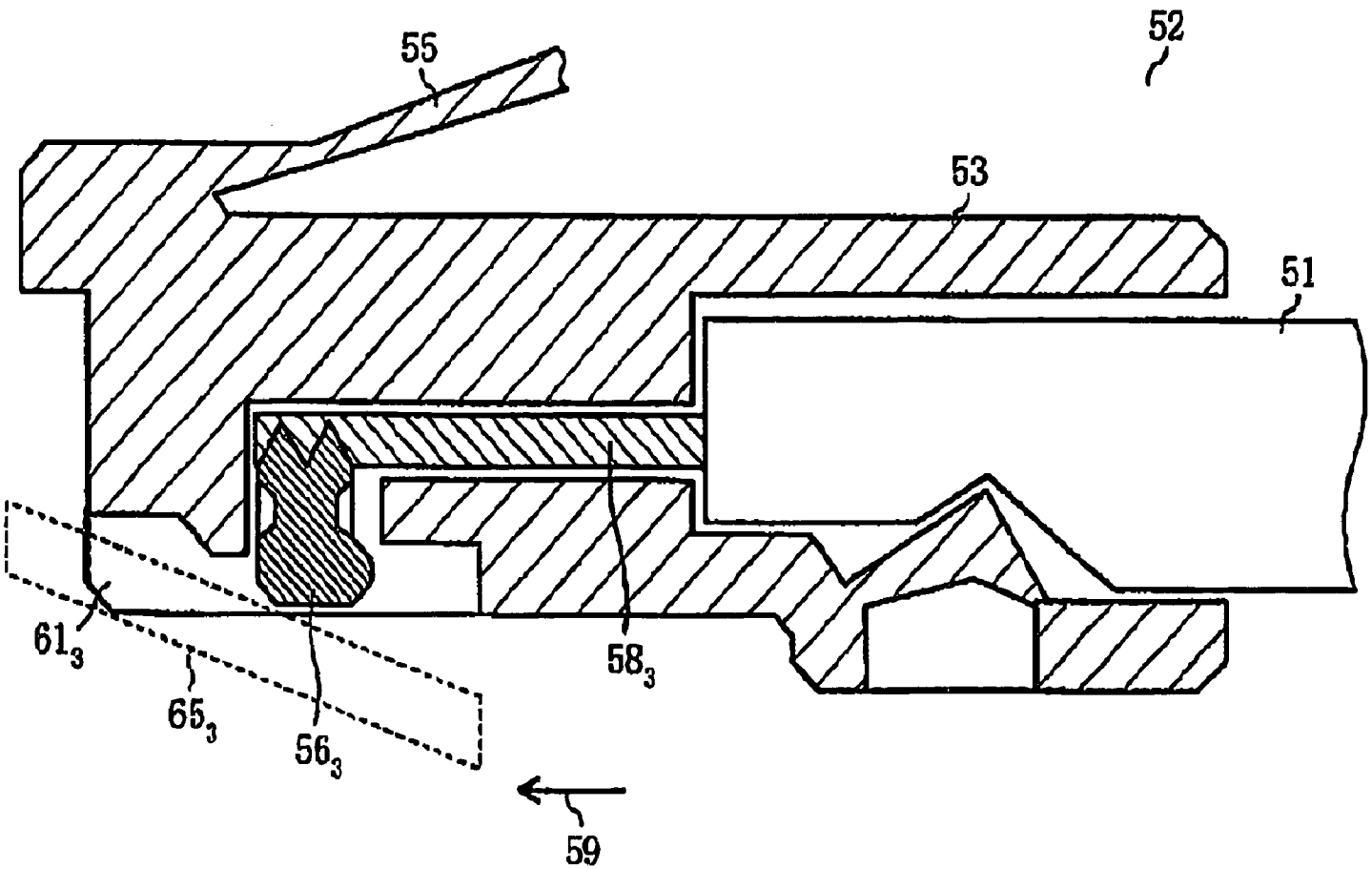
FIG. 5 is a longitudinal sectional view of the modular plug of FIG. 1 coupled with the modular jack, taken similarly to FIG. 3.

Referring to FIG. 5, there is shown the modular plug of FIG. 1 coupled to the modular jack in the section similar to the section of FIG. 3. The modular housing 53 of the modular plug 52 has a groove 61 receiving therein a corresponding terminal 56, the groove 61 being disposed at the front end portion of the modular housing 53 as viewed in the inserting direction. The groove $61_3$ corresponding to the retracted terminal $56_3$ has an extending rear portion at the rear side of the retracted terminal $56_3$, whereby the groove $61_3$ has a larger length compared to the other grooves $61_1$, $61_2$, $61_4$, $61_5$, $61_7$ and $61_8$. This structure assures that the retracted terminal $56_3$ is contacted with corresponding electrodes $65_3$ of the modular jack upon inserting the modular plug 52 into the opening of the modular jack.

Although FIG. 5 shows the structure for the retracted terminal $56_3$, the structure of the other retracted terminal $56_6$ is similar to the structure of FIG. 5, thereby assuring the contact between the retracted terminal $56_6$ and the corresponding electrode of the modular jack.

The space of the groove $61_3$ or $61_6$ between the retracted terminal $56_3$ or $56_6$ and the front end of the modular housing 53 as well as the space between the top side of the modular plug 52 and the retracted terminal $56_3$ or $56_6$ is provided with a shield member received in a slit for prevention of the cross-talk.

Figure 6:
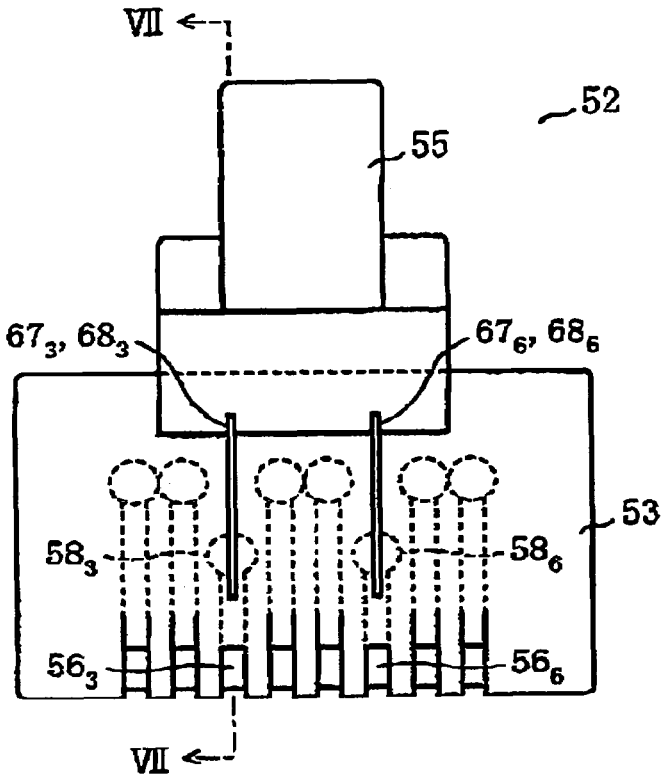
FIG. 6 is a front view of the modular plug of FIG. 1, as viewed from the modular jack to be coupled with the modular plug.
Figure 7:
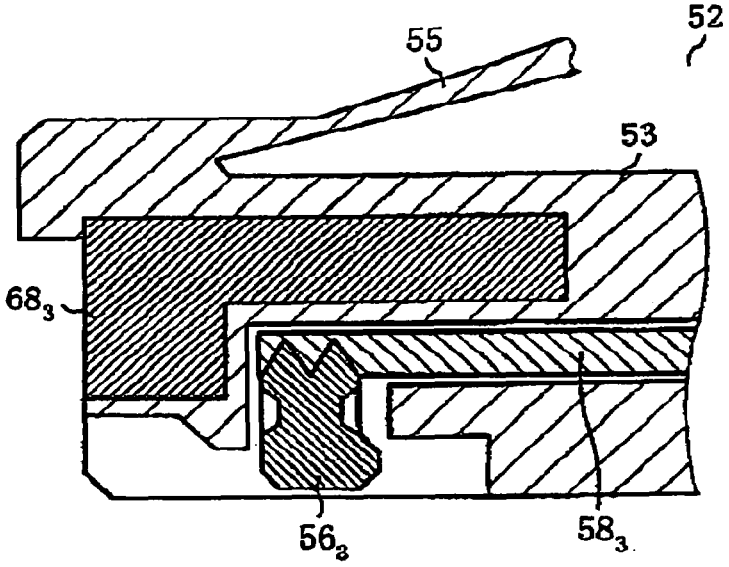
FIG. 7 is a partial end view of a section of the modular plug taken at the third slit in a plane parallel thereto.

FIGS. 6 and 7 show the structure of the shield members, wherein FIG. 6 depicts the front view of the modular plug 52 corresponding to the front view shown in FIG. 4, and FIG. 7 depicts the modular plug 52 in a sectional view taken along line VII—VII in FIG. 6.

The modular housing 53 of the modular plug 52 includes two slits $67_3$ and $67_6$ receiving therein respective shield members $68_3$ and $68_6$. Each slit $67_3$ or $67_6$ is of an L-shape including a first portion overlying the corresponding retracted terminal $56_3$ or $56_6$ and a front end portion of the unraveled wire $58_3$ or $58_6$, and a second portion disposed in front of the corresponding terminal $56_3$ or $56_6$. The shield member $68_3$ or $68_6$ is made of a metallic plate or metallic foil having an L-shaped structure corresponding to the structure of the slit $67_3$ or $67_6$. The shield member $68_3$ or $68_6$ may be made of a plate or film having a radio-wave absorbing function instead. The shield member $68_3$ or $68_6$ may be a film coated by a plating or evaporation technique on the resin wall of the slit $67_3$ or $67_6$.

The shield film coated on the resin wall by plating or evaporation should be electrically isolated from the terminals and exposed portion of the wires for avoiding a short-circuit failure of the signal wires.

Figure 8:
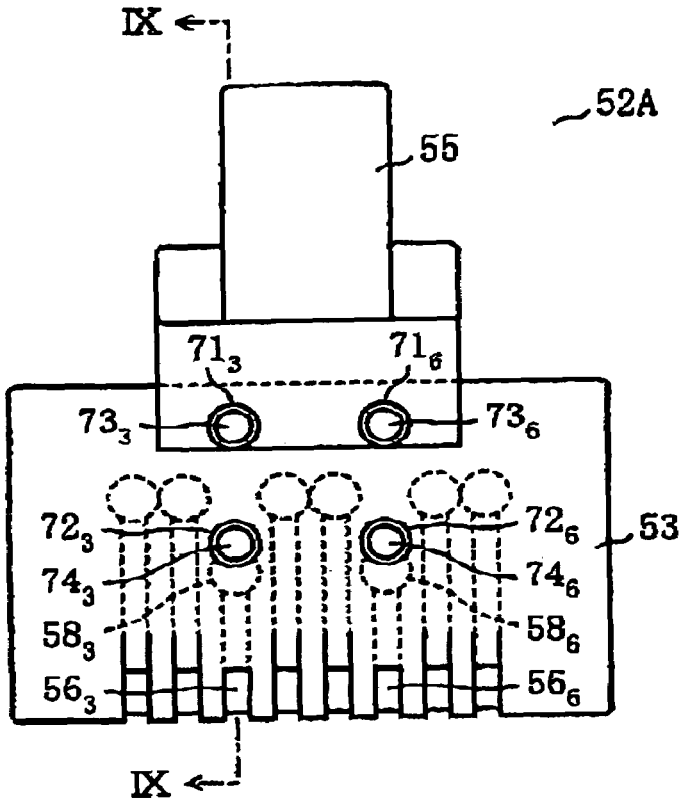
FIG. 8 is a front view of a first modification from the modular plug of FIG. 1 having another cross-talk-prevention member.
Figure 9:
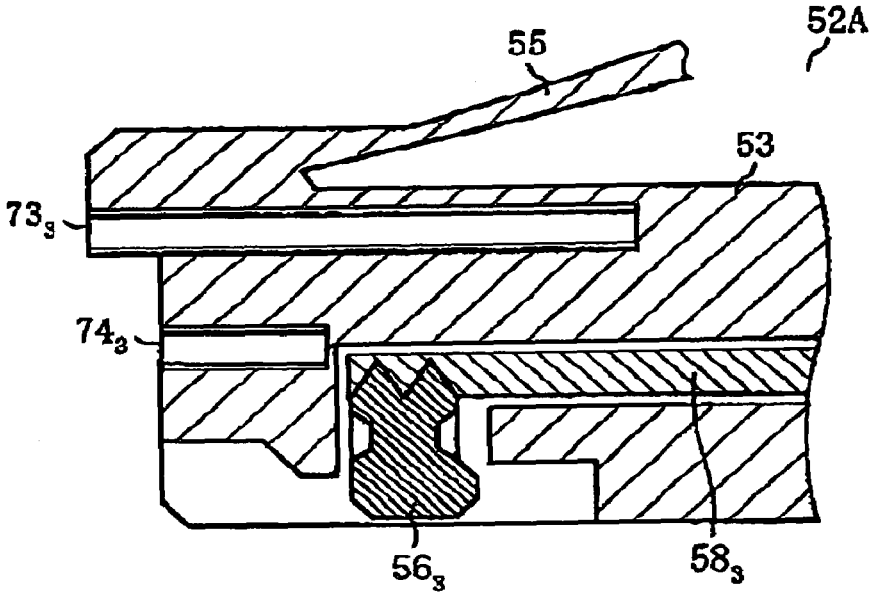
FIG. 9 is a partial end view of a section of the first modification, taken along the axis of the third terminal.

FIGS. 8 and 9 show a first modification from the above embodiment, depicting another example of the shield member, similarly to FIGS. 6 and 7, respectively. FIG. 9 is taken along line IX—IX in FIG. 8. In this modification, the modular plug 52A includes a pair of shield members, i.e., a pair of cylindrical rods $73_3$ and $74_3$ (or $73_6$ and $74_6$), received in respective cylinders $71_3$ and $72_3$ ($71_6$ and $72_6$) for each of the retracted terminals $56_3$ and $56_6$. The pair of cylindrical rods $73_3$ and $74_3$ ($73_6$ and $74_6$) are arranged corresponding to the top edge of the first portion and the bottom edge of the second portion of the L-shaped slit $67_3$ or $67_6$ shown in FIGS. 6 and 7. The cylindrical rod may be a hollow cylinder instead, may be made of a material having a radio-wave absorbing function, or may be formed by plating or evaporation, similarly to the shield member $68_3$ or $68_6$ received in the slot $67_3$ or $68_3$.

The modular plug 52A of the first modification effectively reduces the cross-talk, although the sectional area shielded by the shield members is smaller compared to the structure shown in FIGS. 6 and 7. The modular plug 52A of the first modification has the advantage of higher mechanical strength compared to the modular plug shown in FIGS. 6 and 7.

Figure 10:
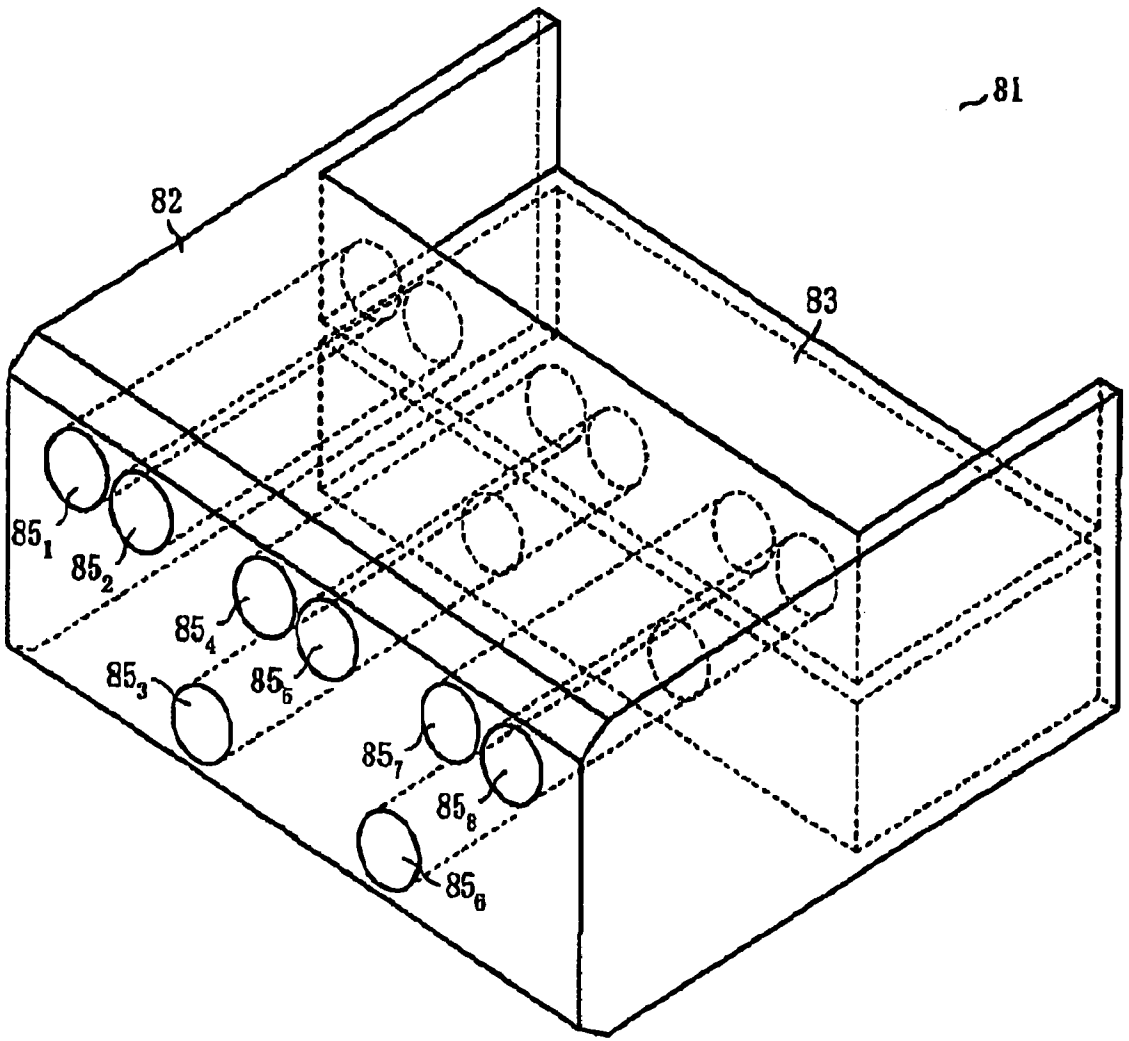
FIG. 10 is a perspective view of an auxiliary wire arrangement device for use in a second modification from the modular plug of FIG. 1.
Figure 11:
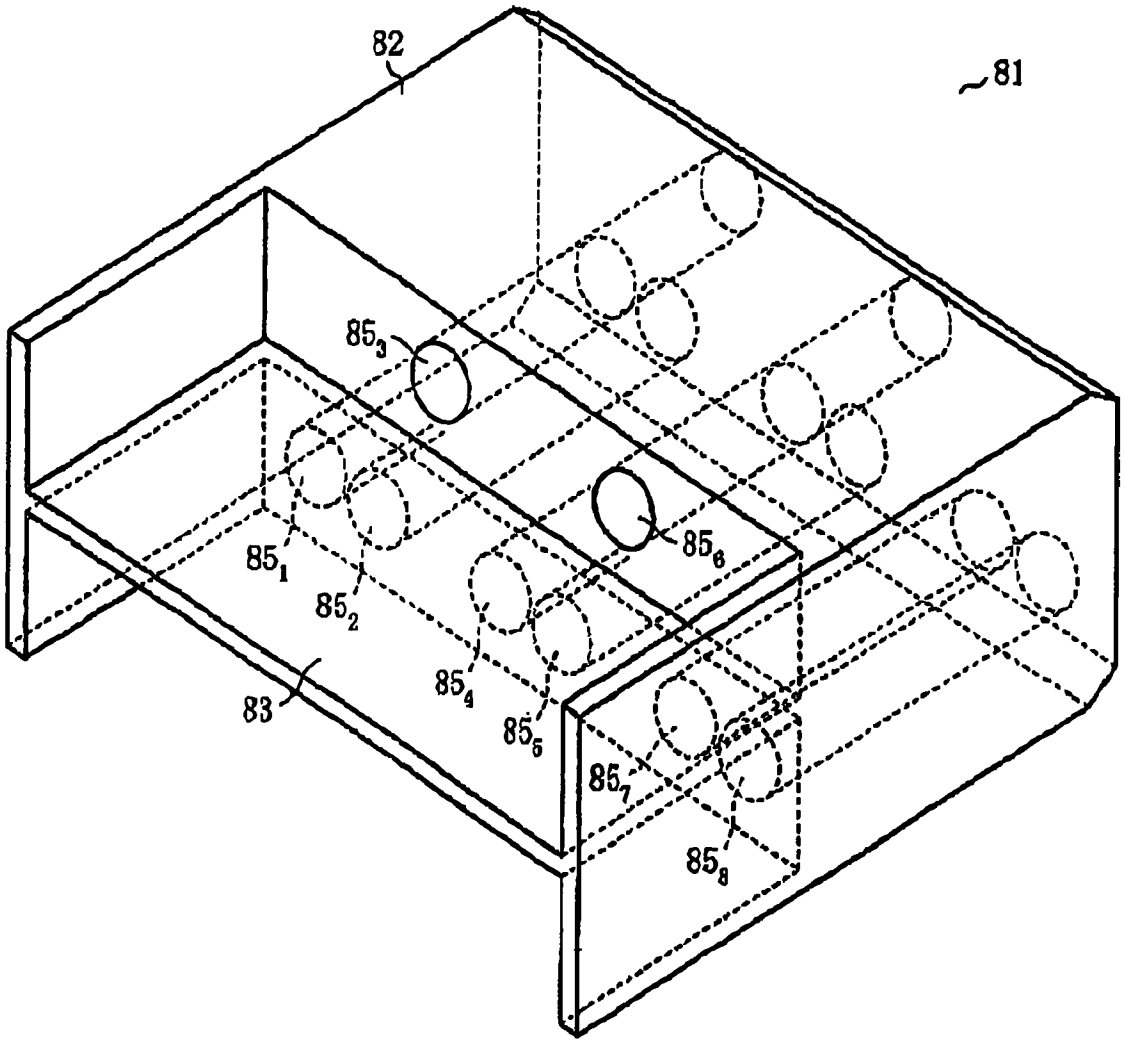
FIG. 11 is another perspective view of the auxiliary wire arrangement device shown in FIG. 10, as viewed from another direction.

FIGS. 10 and 11 show an auxiliary wire arrangement device (wire arrangement device) to be removably installed in a modular plug according to a second modification from the embodiment shown in FIG. 1. The wire arrangement device, generally designated by numeral 81, may be installed in the modular plug 52 shown in FIG. 1 by receiving the wire arrangement device 81 in a hollow space formed beforehand in the modular plug 52. The front end of the wire arrangement device 81 shown in FIG. 10 corresponds to the front end of the modular plug 52 shown in FIG. 1. FIG. 11 shows the wire arrangement device shown in FIG. 10 as topside down from the posture shown FIG. 10, and the front end shown in FIG. 11 corresponds to the rear end shown in FIG. 1 at which the modular cable 51 is inserted.

A wire arrangement device itself is used in a conventional modular plug as a component thereof. The modular plug of the first modification into which the wire arrangement device 81 is to be installed has retracted terminals and other terminals such as shown in FIG. 1. The wire arrangement device 81 includes a group of slots $\mathbf{85}_3$ and $\mathbf{85}_6$ for receiving therein unraveled wires to be connected to the retracted terminals and a group of slots $\mathbf{85}_1$, $\mathbf{85}_2$, $\mathbf{85}_4$, $\mathbf{85}_5$, $\mathbf{85}_7$ and $\mathbf{85}_6$ for receiving therein unraveled wires to be connected to the other terminals, the two groups of wires being arranged in different arrays or different heights. There is provided a horizontal separator 83 in the wire arrangement device 81 for separating the wires received in the group of slots for the retracted terminals from the wires received in the group of slots for the other terminals, as shown in FIG. 11.

The body 82 of the wire arrangement device 81 may be made of resin formed as an integrated device by using a molding technique or an assembled device including a plurality of parts adhered by using adhesive. The resin may be admixed with or may include therein an electrically conductive material. For example, the horizontal separator or other portion may receive therein a metallic film or a conductive material such as metallic powder or graphite powder, or may be coated with metallic film by plating or evaporation of a material having a radio-wave absorbing function.

Figure 12:
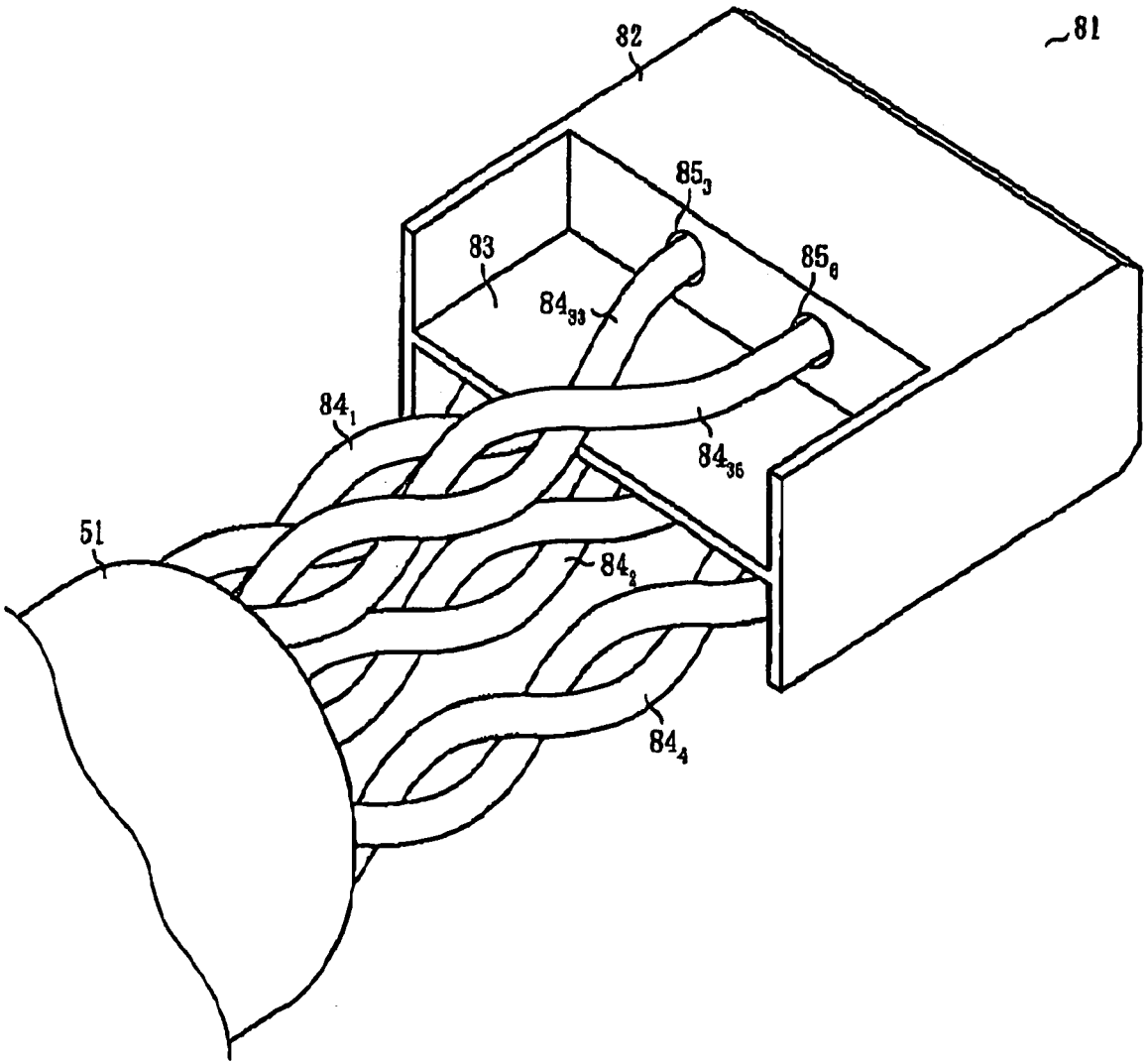
FIG. 12 is a perspective view showing the auxiliary wire arrangement device shown in FIG. 11 together with the modular cable attached thereto.

FIG. 12 shows the wire arrangement device 81 in which wires of a modular cable are inserted. The unraveled wires released from the twisting of the wire pairs $\mathbf{84}_1$ to $\mathbf{84}_8$ are inserted into the respective slots $\mathbf{85}_1$ to $\mathbf{85}_8$, wherein the horizontal separator 83 having a shield function separates the groups of wires into the upper group and the lower group. This reduces the cross-talk in the modular plug including therein the wire arrangement device 81.

Figure 13:
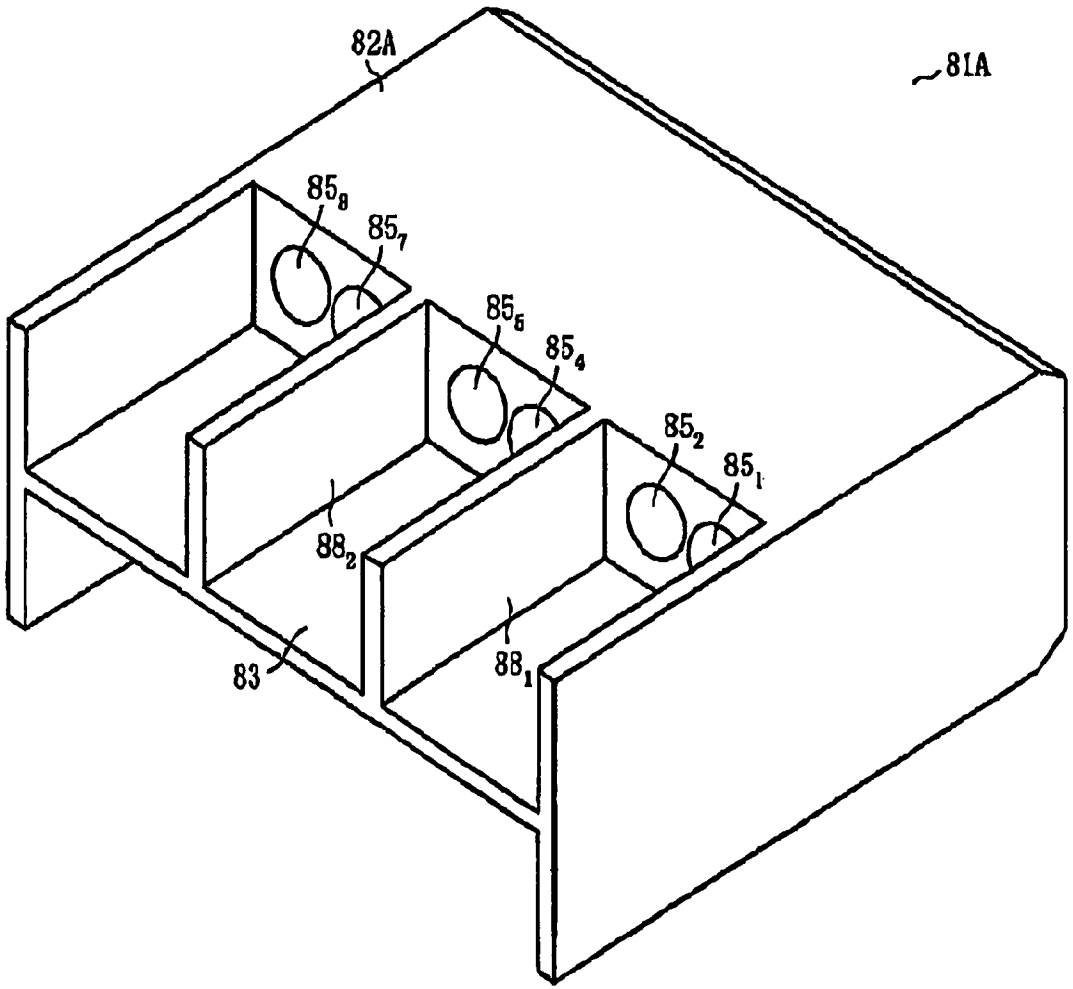
FIG. 13 is a perspective view of an auxiliary wire arrangement device for use in a third modification from the modular plug of FIG. 1.

FIG. 13 shows another wire arrangement device, generally designated by numeral 81A, for use in a modular plug according to a third modification from the modular plug shown in FIG. 1. In this modification, the horizontal separator 83 includes a plurality of vertical partitions $\mathbf{88}_1$ and $\mathbf{88}_2$ for horizontally separating the wires in the upper group of wires. The vertical partitions $\mathbf{88}_1$ and $\mathbf{88}_2$ may be formed integrally with the horizontal separator 83 or with the auxiliary wire arrangement device 82A by using a molding technique.

The horizontal separator 83 and the vertical partitions $\mathbf{88}_1$ and $\mathbf{88}_2$ of the third modification may be made of resin admixed with metallic powder or material having a radio-wave absorbing function. The modular plug including therein this horizontal separator 83 reduces the cross-talk between the wires.

Figure 14:
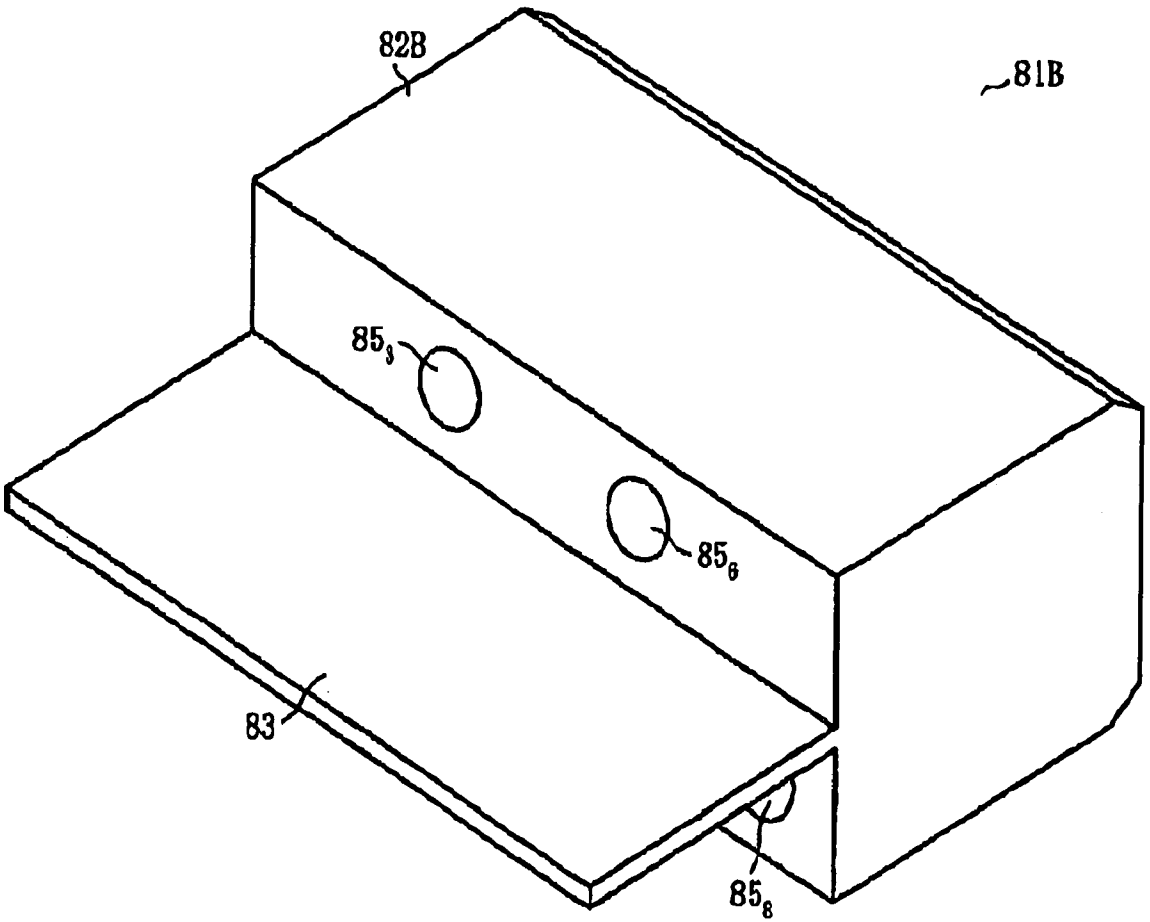
FIG. 14 is a perspective view of an auxiliary wire arrangement device for use in a fourth modification from the modular plug of FIG. 1.

FIG. 14 shows another example of the auxiliary wire arrangement device 81B, which includes the body 82B of the device and a horizontal separator 83 having open lateral sides along the extending direction of the wires. The other structure and material thereof are similar to those of the wire arrangement devices 81 and 81A described heretofore, thereby providing the modular plug with a cross-talk reducing function.

Figure 15:
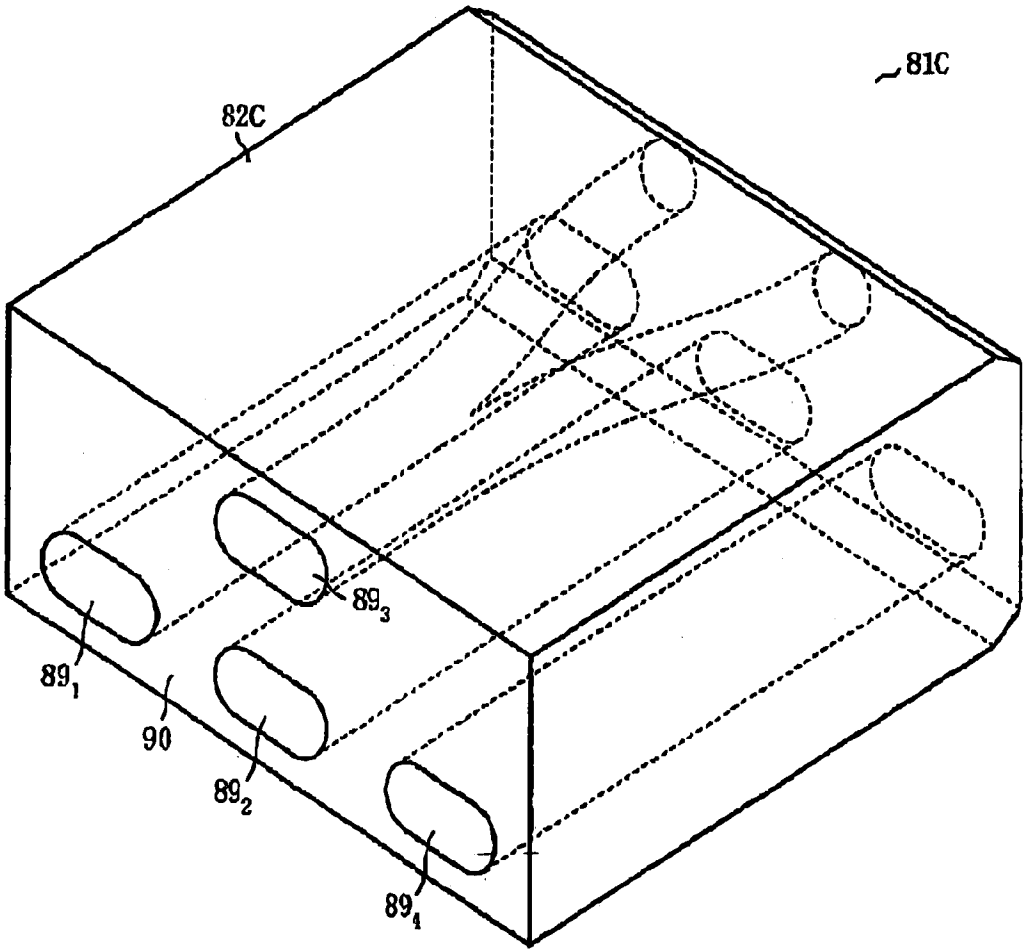
FIG. 15 is a perspective view of an auxiliary wire arrangement device for use in a fifth modification from the modular plug of FIG. 1.

FIG. 15 shows another example of the auxiliary wire arrangement device to be installed in a modular plug according to a sixth modification from the modular plug of FIG. 1. The wire arrangement device 81C includes therein wide slots $\mathbf{89}_1$ to $\mathbf{89}_4$ each receiving therein two unraveled wires of a single pair at the rear end of the device for insertion of the wires. The wide slot $\mathbf{89}_3$ is separated at the intermediate position into two slots each for receiving one of the unraveled wires of the single pair to guide the wire toward the corresponding retracted terminal.

The other structure and material of the wire arrangement device 81C are similar to those of the wire arrangement devices described heretofore for allowing the modular plug to have a cross-talk reducing function.

Figure 16:
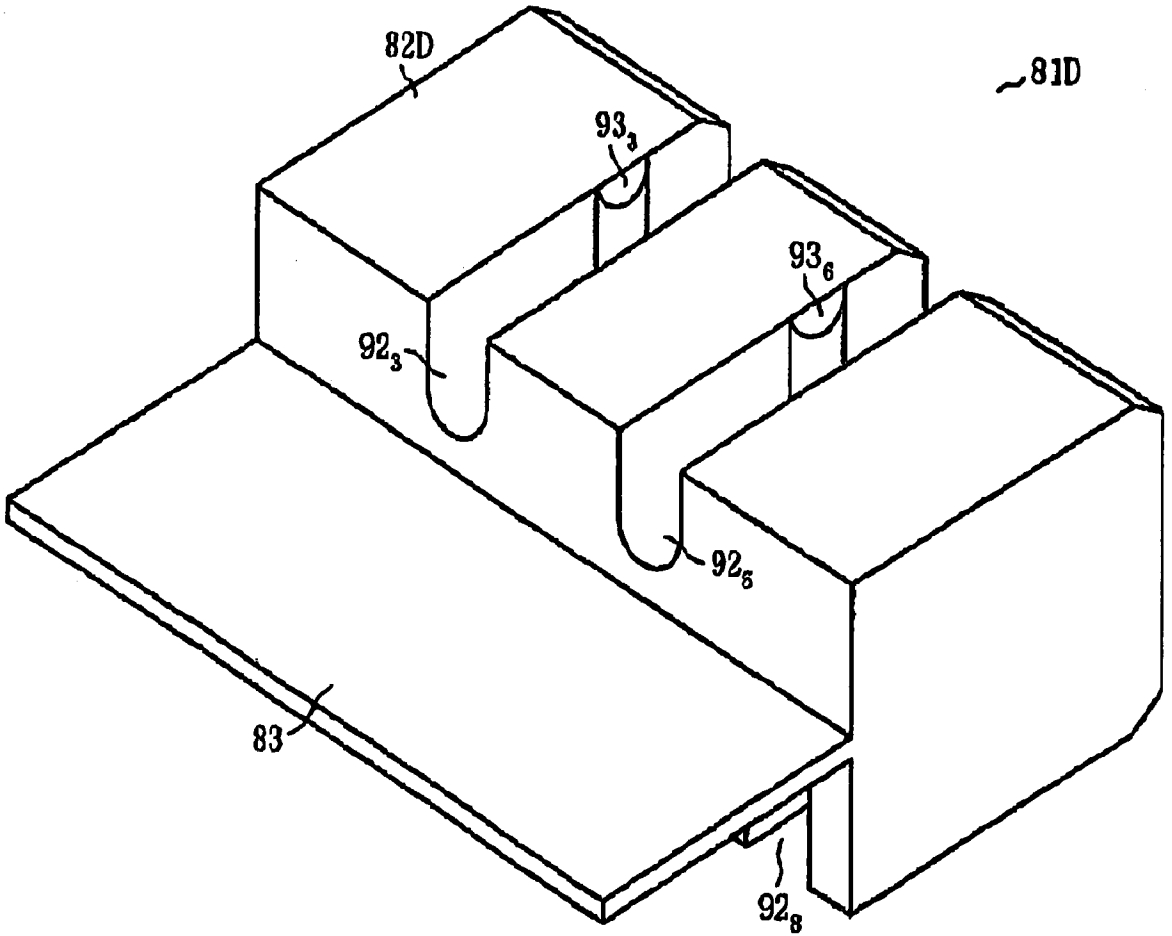
FIG. 16 is a perspective view of an auxiliary wire arrangement device for use in a sixth modification from the modular plug of FIG. 1.

FIG. 16 shows a wire arrangement device modified from the wire arrangement device shown in FIG. 14 and for use in a sixth modification from the modular plug 52 shown in FIG. 1. The wire arrangement device 81D in the sixth modification is similar to the wire arrangement device 81B except that each slot 92 in this modification is an open slot having an open top through which the unraveled wire is exposed. Each open slot 92 has a protrusion 93 protruding from the wall of the slot 92 for preventing the received wire from exiting the open slot 92 inadvertently.

Figure 17:
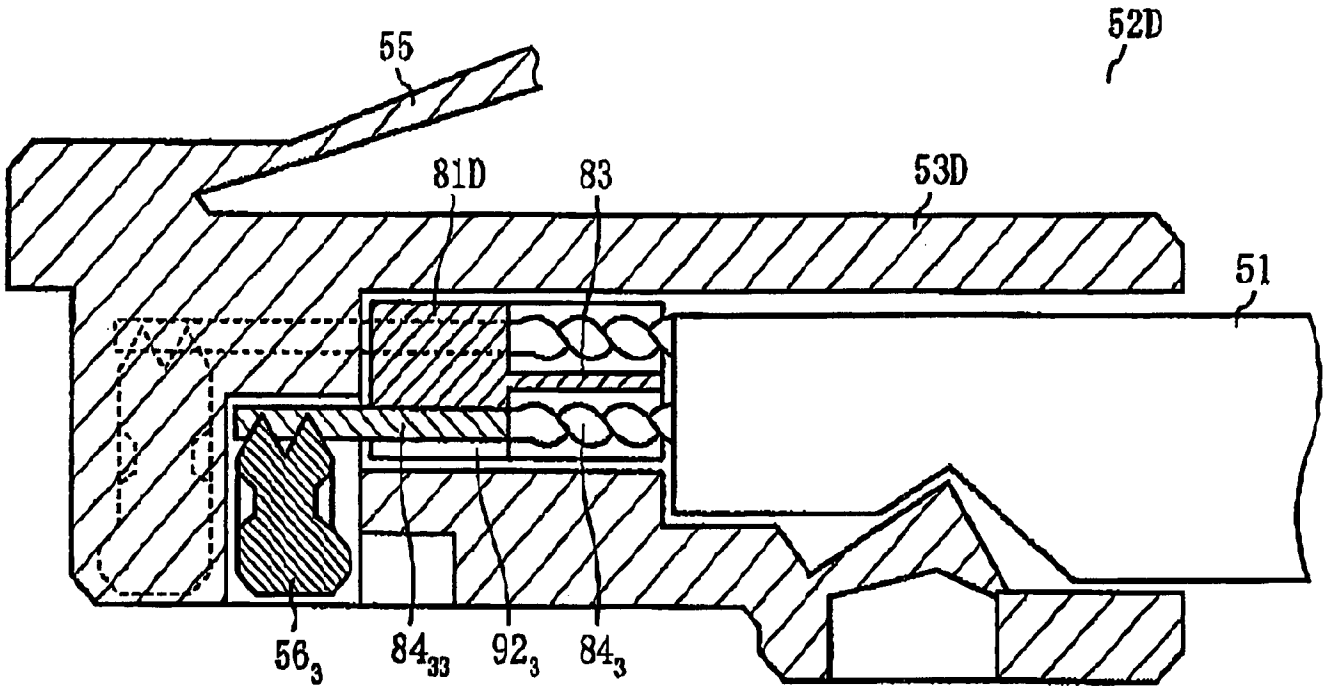
FIG. 17 is an end view of a section of the modular plug including therein the auxiliary wire arrangement device shown in FIG. 16.

FIG. 17 shows, similarly to FIG. 3, a modular plug including therein the wire arrangement device 81D shown in FIG. 16. The twisted-wire pairs 84 extend from the modular cable 51, and are unraveled before the inlet of the slots 92. The unraveled wire $\mathbf{84}_{33}$ for the retracted terminal $\mathbf{56}_3$ is received in and guided by the slot $\mathbf{92}_3$, and then fixed and contacted by the terminal $\mathbf{56}_3$ at the tip of the unraveled wire $\mathbf{84}_{33}$. The unraveled wire for the other terminals are also received in and guided by the slots formed in the wire arrangement device 81D toward the other terminals.

Figure 18:
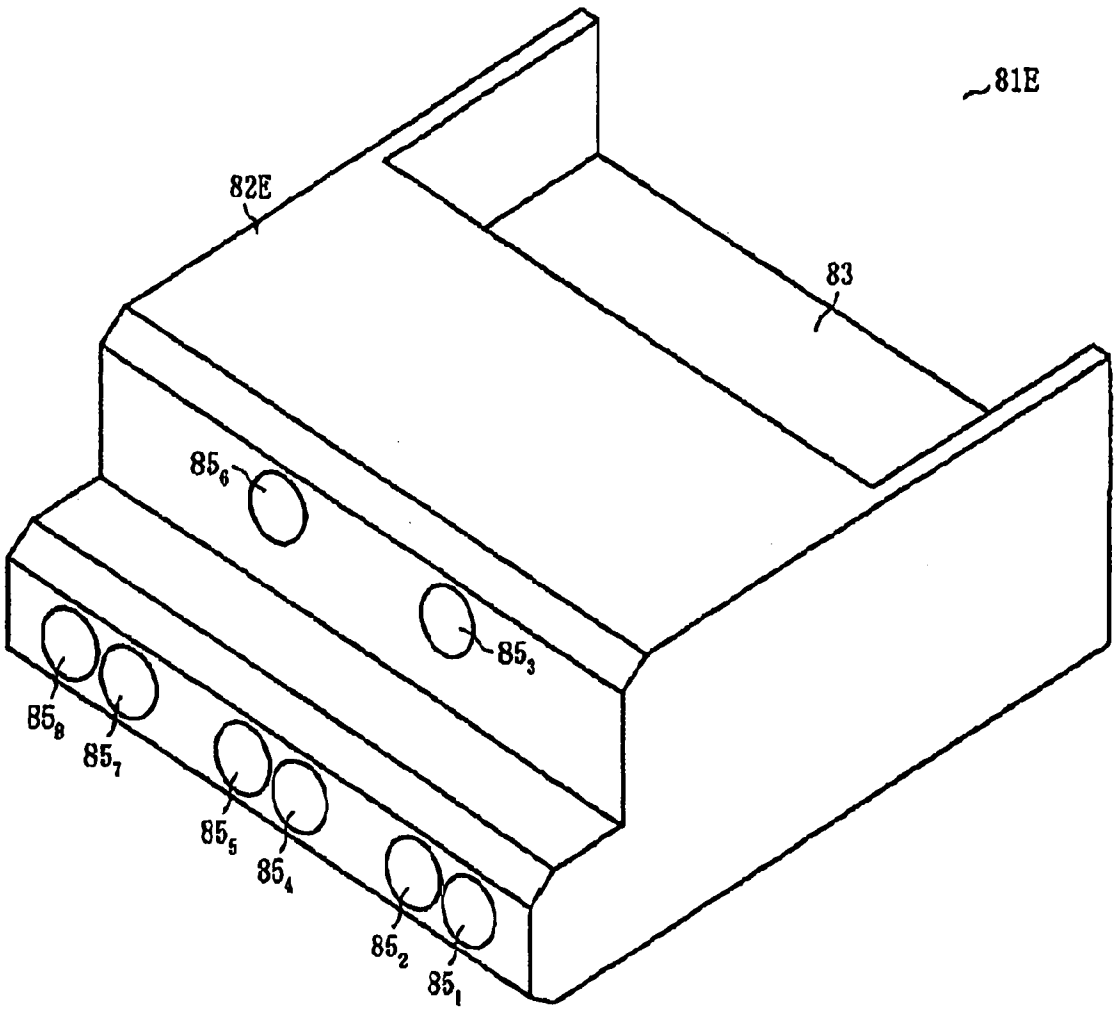
FIG. 18 is a perspective view of an auxiliary wire arrangement device for use in a seventh modification from the modular plug of FIG. 1.

FIG. 18 shows another example of the wire arrangement device for use in a modular plug according to a seventh modification. The wire arrangement device 81E shown in FIG. 18 has a front end wherein the outlets of the slots $\mathbf{85}_3$ and $\mathbf{85}_6$ corresponding to the retraced terminals $\mathbf{56}_3$ and $\mathbf{56}_6$ (FIG. 1) are retraced in the inserting direction from the outlets of the slots $\mathbf{85}_1$, $\mathbf{85}_2$, $\mathbf{85}_4$, $\mathbf{85}_5$, $\mathbf{85}_7$ and $\mathbf{85}_8$ corresponding to the other terminals $\mathbf{56}_1$, $\mathbf{56}_2$, $\mathbf{56}_4$, $\mathbf{56}_5$, $\mathbf{56}_7$ and $\mathbf{56}_8$ (FIG. 1).

Figure 19:
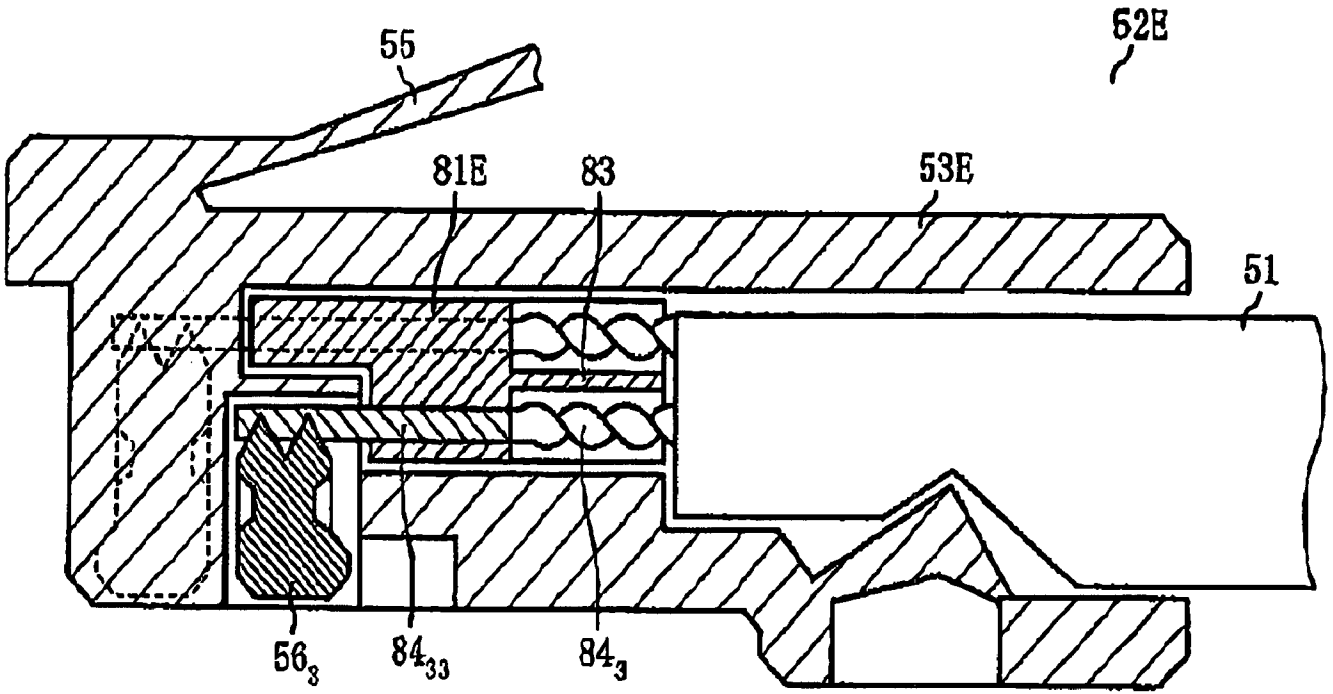
FIG. 19 is an end view of a section of the modular plug of the seventh modification including the auxiliary wire arrangement device installed therein.

FIG. 19 shows, similarly to FIG. 3, the modular plug including the wire arrangement device of FIG. 8 in a sectional view taken along axis of the slot $\mathbf{85}_3$ passing through the third terminal $\mathbf{56}_3$. The unraveled wire $\mathbf{84}_3$ is received in and guided by the slot $\mathbf{85}_3$, and fixed and contacted by the third terminal $\mathbf{56}_3$.

The body 82E of the wire arrangement device 81E is made of resin admixed with conductive powder or radio-wave absorbing material, for example, and isolates the unraveled wires $\mathbf{84}_{33}$ from the other group of wires. This reduces the cross-talk in the modular plug.

Figure 20:
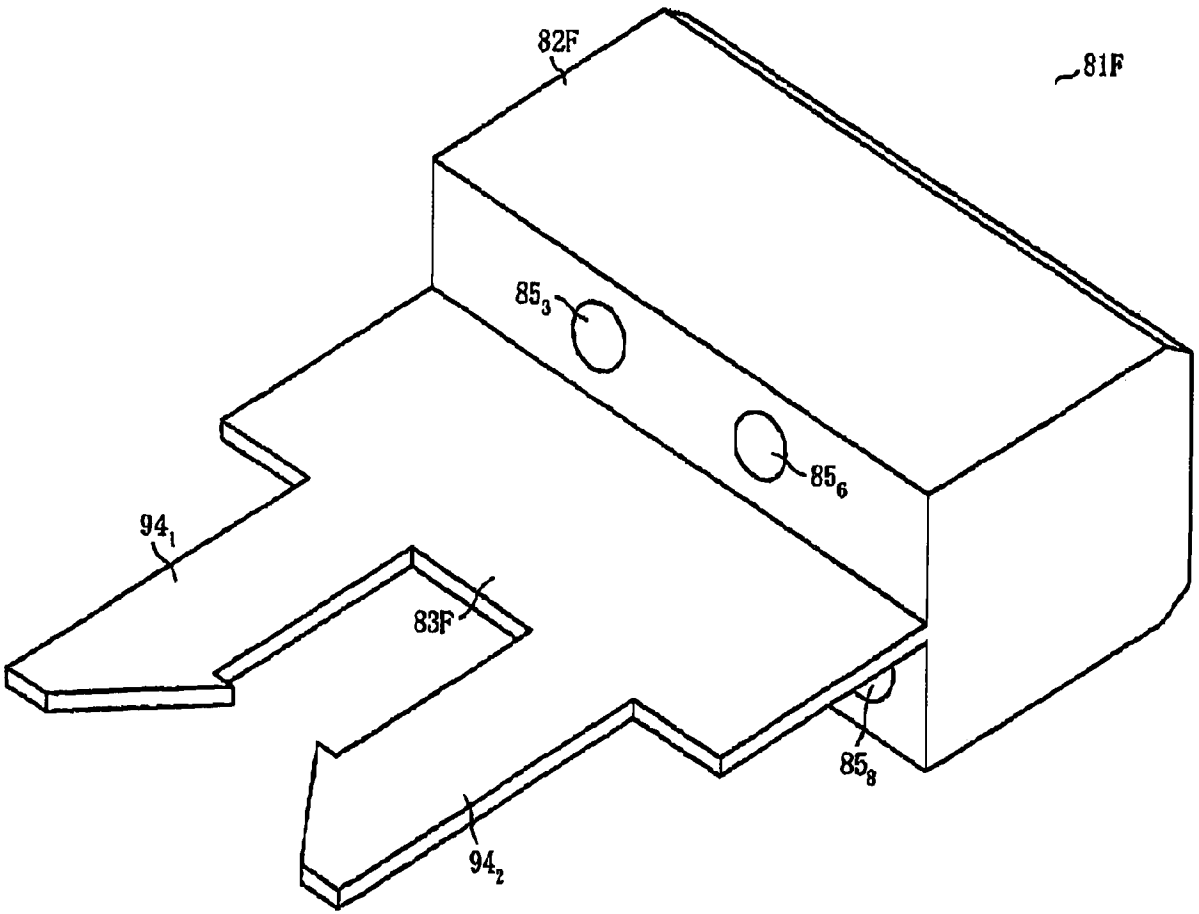
FIG. 20 is a perspective view of an auxiliary wire arrangement device for use in an eighth modification from the modular plug of FIG. 1.

FIG. 20 shows a wire arrangement device for use in a modular plug according to an eighth modification. The wire arrangement device 81F has a body 82F and a horizontal separator 83 including a pair of projections $\mathbf{94}_1$ and $\mathbf{94}_2$ disposed at the rear end of the separator 83. Each projection $\mathbf{94}_1$ or $\mathbf{94}_2$ has a taper in the vicinity of the rear end, and a hook at the proximal end of the taper. Both the tapers are such that the projections $\mathbf{94}_1$ and $\mathbf{94}_2$ have therebetween a larger distance toward the distal ends, or rear ends, of the tapers. Both the hooks provide a minimum distance between both the projections $\mathbf{94}_1$ and $\mathbf{94}_2$ at the location of the hooks.

Figure 21:
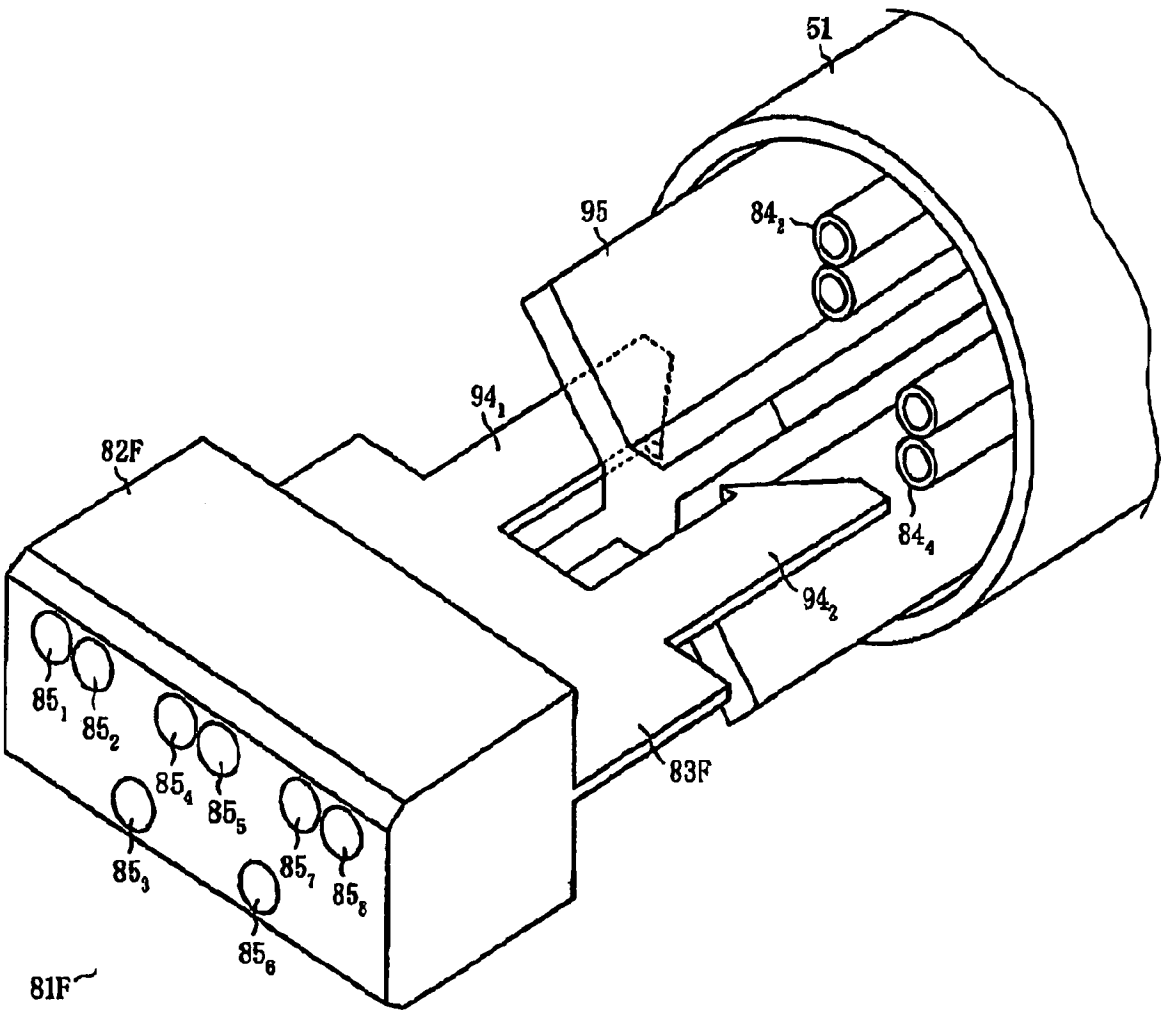
FIG. 21 is a perspective view showing the auxiliary wire arrangement device installed in the modular plug of the eight modification and connected to the modular cable.

FIG. 21 shows the wire arrangement device 81F of FIG. 20 and coupled to a modular cable 51. The modular cable 51 includes therein a cross-shaped member 95 having a cross shape in the cross section thereof for separating the space within the cable 51 into four sub-spaces each receiving therein twisted-wire pair such as $\mathbf{84}_2$ or $\mathbf{84}_4$. The pair of projections $\mathbf{94}_1$ and $\mathbf{94}_2$ sandwich therebetween the central hub of the cross-shaped member 95. The cross-shaped member 95 and the projections $\mathbf{94}_1$ and $\mathbf{94}_2$ are combined so that if one of the four plates of the cross-shaped member 95 overlies the first projection $\mathbf{94}_1$, then the opposing one of the four plates underlies the second projection $\mathbf{94}_2$.

The structures of the tapers and the hooks of the projections $\mathbf{94}_1$ and $\mathbf{94}_2$ fix the cross-shaped member 95 with respect to the wire arrangement device 81F, wherein the projections $\mathbf{94}_1$ and $\mathbf{94}_2$ have a fixing function for the cross-shaped member 95 to allow an easy assembly of the modular cable 51 and the modular plug 81F. Each wire pair is extended in each sub-space, with the projections $\mathbf{94}_1$ and $\mathbf{94}_2$ sandwiching therebetween the central hub of the cross-shaped member 95, and then inserted into the corresponding slot 85 for connecting to the corresponding terminals in the modular plug.

Figure 22:
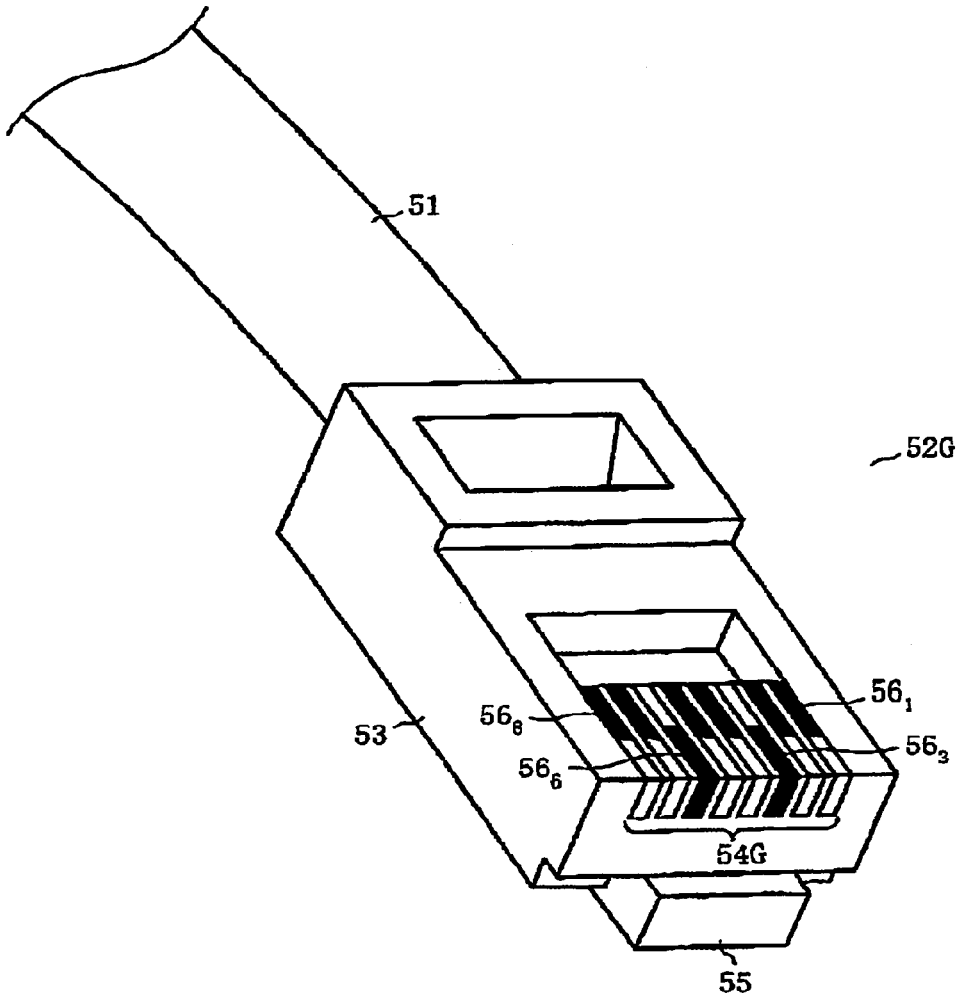
FIG. 22 is a perspective view of a modular plug according to a ninth modification from the modular plug of FIG. 1.

With reference to FIG. 22, further modification of the modular plug from the first through eighth modifications will be described hereinafter. In the first through eighth modifications, as described before with reference to FIG. 1, terminals $\mathbf{56}_1$, $\mathbf{56}_2$, $\mathbf{56}_4$, $\mathbf{56}_5$, $\mathbf{56}_7$ and $\mathbf{56}_8$ are disposed at the front end of the modular plug 52 whereas terminals $\mathbf{56}_3$ and $\mathbf{56}_6$ are retracted from the front end of the modular plug 52.

The further modification shown in FIG. 22 is such that terminals $\mathbf{56}_1$, $\mathbf{56}_2$, $\mathbf{56}_4$, $\mathbf{56}_5$, $\mathbf{56}_7$ and $\mathbf{56}_8$ are retraced from the front end of the modular plug 52G whereas terminals $\mathbf{56}_3$ and $\mathbf{56}_6$ are disposed at the front end of the modular plug 52G.

The number of the total terminals and the number of each group of terminals may be selected as desired depending on the design of the modular cable.

As described heretofore, the modular plugs of the above embodiments allow the length of the unraveled wires running parallel to one another without a shield therebetween to be reduced, thereby reducing the cross-talk between the unraveled wires.

The auxiliary wire arrangement device, if used in, the modular plug, reduces the capacitive coupling between the unraveled wires, and also allow the connection of the modular plug to the modular cable to be performed with ease.

The combination of the cross-shaped member used in the modular cable and the separator including a pair of projections allows a stable connection of the wires to the terminal in the modular plug. The wire arrangement device having a separator including the projections may be used only for the modular cable having therein a cross-shaped member, with the modular housing being used for any type of the modular cable. This structure allows a single type of the modular housing to be used in a wide variety of the modular cables including one having the cross-shaped member.

Since the above embodiments are described only for examples, the present invention is not limited to the above embodiments and various modifications or alterations can be easily made therefrom by those skilled in the art without departing from the scope of the present invention.

What is claimed is:

1. A modular plug comprising:

a modular housing having a front surface to he coupled with a modular jack and a rear end to be coupled with a modular cable;

a first group of terminals arranged in said modular housing in a first array parallel to said front surface; and a second group of terminals arranged in said modular housing in a second array parallel to said first array, said first array being disposed at a specified distance retracted from said second array in a direction normal to said front surface, said first and second groups of terminals being located so that said first and second groups of terminals are contacted with respective electrodes of said modular jack upon coupling of said modular housing to said modular jack;

wherein said modular housing includes a plurality of grooves receiving respective said terminals in said first and second groups, and said grooves receiving therein said first group of terminals are longer than said grooves receiving therein said second group of terminals by a length corresponding to said specified distance.

2. The modular plug according to claim 1, wherein said second group of terminals has a front end substantially aligned with said front surface of said modular housing.

3. The modular plug according to claim 1, wherein said modular housing includes first and second groups of slots corresponding to said first and second groups, respectively, of said terminals, front ends of said first groups of slots being retracted from front ends of said second groups of slots.

4. The modular plug according to claim 1, wherein said modular housing receives a shield member running parallel to unraveled wires to be connected to said second group of terminals.

5. The modular plug according to claim 3, wherein said first and second groups of slots have a shield function.

6. The modular plug according to claim 1, further comprising a wire arrangement device removably received in said modular housing and including therein a plurality of slots corresponding to said terminals in said first and second groups, each of said slots receiving therein one or a pair of unraveled wires of said modular cable.

7. The modular plug according to claim 6, wherein said wire arrangement device includes a separator isolating unraveled wires to be connected to said first group of terminals from unraveled wires to be connected to said second group of terminals.

8. The modular plug according to claim 7, wherein said separator includes a pair of projections at a rear end of said separator.

9. The modular plug according to claim 6, wherein said slots have a shield function.

10. The modular plug according to claim 9, wherein said slots receiving therein unraveled wires to be connected to said second group of terminals are longer than said slots receiving therein unraveled wires to be connected to said first group of terminals by a length corresponding to said specified distance.

11. The modular plug according to claim 6, wherein at least one of said slots are divided into two slot portions corresponding to two terminals in said first or second group.

* * * * *